US007296386B2

(12) United States Patent
Leek

(10) Patent No.: US 7,296,386 B2
(45) Date of Patent: Nov. 20, 2007

(54) CONCENTRIC HOLDOWN CONNECTION

(75) Inventor: William F. Leek, Carmel, CA (US)

(73) Assignee: Simpson Strong-Tie Co., Inc., Pleasanton, CA (US)

( * ) Notice: Subject to any disclaimer, the term of this patent is extended or adjusted under 35 U.S.C. 154(b) by 406 days.

(21) Appl. No.: 10/920,577

(22) Filed: Aug. 17, 2004

(65) Prior Publication Data

US 2006/0037265 A1 Feb. 23, 2006

(51) Int. Cl.
*E04B 1/21* (2006.01)
*E04B 1/38* (2006.01)

(52) U.S. Cl. ..... 52/296; 52/298; 52/707

(58) Field of Classification Search ..... 52/295–298, 52/712, 127.6, 127.7, 27.12, 704, 707, 708; 248/500, 903, 188.1, 188.4; 256/65.14; 403/232.1, 241; 108/190, 186; 411/14, 411/427; 16/42 R, 42 T
See application file for complete search history.

(56) References Cited

U.S. PATENT DOCUMENTS

| | | | | |
|---|---|---|---|---|
| 573,452 | A | 12/1896 | Delahunt | |
| 622,028 | A * | 3/1899 | Welz | 248/188.4 |
| 967,107 | A | 8/1910 | Cook et al. | |
| 1,335,617 | A | 3/1920 | Solomon | |
| 1,503,148 | A | 7/1924 | Bernstrom | |
| 1,578,947 | A | 3/1926 | Alber | |
| 1,696,288 | A | 12/1928 | Underwood | |
| 2,169,474 | A | 8/1939 | Pederson | |
| 2,227,713 | A | 1/1941 | Higgins | |
| 2,321,221 | A | 6/1943 | Linehan | |
| 2,454,739 | A * | 11/1948 | Hendrickson | 16/30 |
| 2,871,069 | A * | 1/1959 | Weber | 384/420 |
| 3,413,773 | A | 12/1968 | Fitzgerald | |
| D224,083 | S | 7/1972 | Gilb | |
| 4,096,677 | A | 6/1978 | Gilb | |
| 4,192,118 | A | 3/1980 | Gilb | |
| 4,199,908 | A | 4/1980 | Teeters | |
| 4,321,776 | A | 3/1982 | Delight | |
| 4,367,864 | A | 1/1983 | Eldeen | |
| 4,387,543 | A | 6/1983 | Tschan et al. | |

(Continued)

FOREIGN PATENT DOCUMENTS

| | | |
|---|---|---|
| DE | 1 205 686 | 11/1965 |

(Continued)

OTHER PUBLICATIONS

Snap Fit, http://64.233.161.104/search?q=cache:VbzaAOfZuGcJ:fab.cba.mit.edu/classes/961.04/projects/Snap_fit.ppt+snap+fit&hl=en&gl=us&ct=clnk&cd=2.*

(Continued)

*Primary Examiner*—Lanna Mai
*Assistant Examiner*—Christine T. Cajilig
(74) *Attorney, Agent, or Firm*—Law Offices of James R. Cypher

(57) ABSTRACT

A concentric holdown connection joining a held building structural member to a holding building structural member including a holdown connector having at least one upright portion operably connected to the held building structural member and a seat portion. A combination member having a threaded opening therethrough connects the holdown member to a threaded anchor member connected to the holding building structural member. In a preferred form the combination member has a donut-like configuration.

9 Claims, 15 Drawing Sheets

U.S. PATENT DOCUMENTS

| | | | | |
|---|---|---|---|---|
| 4,480,941 | A | 11/1984 | Gilb et al. | |
| 4,530,194 | A | 7/1985 | Linton et al. | |
| 4,587,788 | A | 5/1986 | Bielicki | |
| 4,603,531 | A | 8/1986 | Nash | |
| 4,614,070 | A | 9/1986 | Idland | |
| 4,665,672 | A | 5/1987 | Commins | |
| 4,717,279 | A | 1/1988 | Commins | |
| 4,744,192 | A | 5/1988 | Commins | |
| 4,825,621 | A | 5/1989 | Jensen | |
| 4,869,467 | A | 9/1989 | Kellison | |
| 4,875,314 | A | 10/1989 | Boilen | |
| 4,890,436 | A | 1/1990 | Colonias | |
| 4,924,648 | A | 5/1990 | Gilb et al. | |
| 4,995,206 | A | 2/1991 | Colonias et al. | |
| 5,092,097 | A | 3/1992 | Young | |
| 5,104,252 | A | 4/1992 | Colonias | |
| 5,212,919 | A | 5/1993 | Shaw et al. | |
| 5,249,404 | A | 10/1993 | Leek | |
| 5,301,485 | A | 4/1994 | Shaw et al. | |
| 5,303,520 | A | 4/1994 | Gozdziak | |
| 5,307,603 | A | 5/1994 | Chiodo | |
| 5,333,435 | A | 8/1994 | Leek | |
| 5,375,384 | A | 12/1994 | Wolfson | |
| 5,380,116 | A | 1/1995 | Colonias | |
| 5,384,993 | A | 1/1995 | Phillips | |
| 5,410,854 | A | 5/1995 | Kimmell et al. | |
| 5,467,569 | A | 11/1995 | Chiodo | |
| 5,467,570 | A | 11/1995 | Leek | |
| 5,501,048 | A | 3/1996 | Nakanishi | |
| 5,531,054 | A | 7/1996 | Ramirez | |
| 5,535,561 | A | 7/1996 | Schuyler | |
| 5,540,530 | A | 7/1996 | Fazekas | |
| 5,570,549 | A | 11/1996 | Lung et al. | |
| 5,575,130 | A | 11/1996 | Chiodo | |
| 5,603,580 | A | 2/1997 | Leek et al. | |
| 5,666,774 | A | 9/1997 | Commins | |
| 5,680,673 | A * | 10/1997 | Beshore | 16/42 R |
| 5,706,626 | A * | 1/1998 | Mueller | 52/800.12 |
| D399,013 | S | 9/1998 | Nguyen | |
| 5,816,281 | A * | 10/1998 | Mixon | 137/14 |
| 5,832,679 | A | 11/1998 | Roth | |
| 5,979,130 | A | 11/1999 | Gregg et al. | |
| 5,987,828 | A | 11/1999 | Hardy | |
| 6,015,138 | A | 1/2000 | Kohlberger et al. | |
| 6,067,769 | A | 5/2000 | Hardy | |
| 6,112,495 | A | 9/2000 | Gregg et al. | |
| 6,141,928 | A | 11/2000 | Platt | |
| 6,158,188 | A | 12/2000 | Shahnazarian | |
| 6,327,985 | B1 * | 12/2001 | Frenkler et al. | 108/147.19 |
| 6,513,290 | B2 * | 2/2003 | Leek | 52/295 |
| 6,523,321 | B1 | 2/2003 | Leek et al. | |
| 6,668,508 | B2 | 12/2003 | Boone et al. | |
| 2001/0002529 | A1 | 6/2001 | Commins et al. | |
| 2006/0032165 | A1 * | 2/2006 | Griffith | 52/298 |

FOREIGN PATENT DOCUMENTS

| | | |
|---|---|---|
| DE | 1205686 | 11/1965 |
| DE | 93 12 522.4 | 12/1993 |
| DE | 9312522 U1 * | 12/1993 |
| WO | WO 02/44486 A1 | 6/2002 |

OTHER PUBLICATIONS

Hughes Manufacturing, Inc., "Product Catalog 1996/1997," Heavy Hold Downs, Hughes Manufacturing, Inc. (Lagro, Florida), front and back page, and p. 41, (1996).

Southeastern Metals Manufacturing Co., Inc., "Construction Hardware," Southeastern Metals Manufacturing Co., Inc. (Jacksonville, Florida), front and back page, and p. 38, (1991).

BMF-Simpson GmbH, "Statische Werte," BMF-Simpson GmbH (Syke, Germany), front and back page, and p. 54, (2002).

Simpson Strong-Tie Company, Inc., "Wood Construction Connectors," Catalog C-2002, Simpson Strong-Tie Company, Inc. (U.S.A.), front and back page, and p. 17, (2001).

Simpson Strong-Tie Company, Inc., "Wood Construction Connectors," Catalog C-2004, Simpson Strong-Tie Company, Inc. (U.S.A.), front and back page, pp. 26-31, 34-38, 44, 45, 48, 49, 128, 141, and 157, (2003).

"HD Holdown." Simpson Strong-Tie Company, Inc. catalog, 1966, p. 13.

"HD Holdown." Simpson Strong-Tie Company, Inc. catalog, 1967, p. 13.

"HD Holdown." Simpson Strong-Tie Company, Inc. catalog, 1968, p. 9.

"HD Holdown." Simpson Strong-Tie Company, Inc. catalog, 1970, p. 16.

"HDN Holdowns." "HD Holdowns" Simpson Strong-Tie Company, Inc. catalog, 1979, p. 5.

"HD/HDN Holdowns." Simpson Strong-Tie Company, Inc. catalog, 1983, p. 7.

"HDA Holdowns." *Connectors for Wood Construction*, Simpson Strong-Tie Co. catalog, 1986, p. 7.

"HDA/HD Holdowns." *Connectors for Wood Construction*, Simpson Strong-Tie Co. catalog, 1990, p. 9.

"HDA/HD Holdowns." Simpson Strong-Tie Co., catalog, 1993, p. 13.

"ES Report PFC-5929. TJ-Shear Panel." ICBO Evaluation Service, Inc. Whittier, California. Reissued Nov. 1, 2002.

*Wood Construction Connectors*, Catalog C-2000, Simpson Strong-Tie Co., Inc. Pleasanton, Calif., p. 31-36 (1999).

"USP Lumber Connectors PHD and UPHD Series Hold-downs," ES Report ER-5830, ICBO Evaluation Service, Inc., Whittier, Calif. (Oct. 1, 2001).

"Hardy Frame, Hardy Frame Heavy Duty, 18-inch Hardy Braced Frame and Hardy Frame Screw," Evaluation Report PFC-5342, ICBO Evaluation Service, Whittier, Calif., (Sep. 1, 1999).

"Descriptions and Typical Installation Details. The Hardy Frame. Based on ICBO Approval #PFC-5342", Simplified Structural Systems, Ventura, Calif. pp. H-1-H4 (Dec. 1, 1999).

"The Hardy Frame," The Hardy Frame, Publisher Unknown (US), pp. 1-4, (received in 1997).

"Simplified Structural Systems. Makers of the Hardy Frame," Product brochure. Simplified Structural Systems, Ventura, Calif. (received in the Offices of James R. Cypher on Jan. 13, 2000).

"Recommendation for the 18" Hardy Frames.", Simplified Structural Systems, Ventura, Calif. 3 page, (received in the Offices of James R. Cypher Jan. 13, 2000).

Tanaka, "House Materials" Product Catalog 2003. Tanaka Co.,Ltd. Japan. p. 82 (2003).

BMF-Simpson GmbH, "Statische Werte," BMF-Simpson GmbH (Syke, Germany), p. 54 (2002).

* cited by examiner

CONCENTRIC HOLDOWN CONNECTION

BACKGROUND

This invention relates to a concentric holdown connection for anchoring a first building structural member or held member to a second building structural member such as a foundation or holding member.

The concentric holdown connection includes a holdown connector and an anchor member that is connected to the holding member, The holdown connector is attached to the held member with fasteners. The anchor member is threadably connected to a combination member seated on the holdown connector.

Holdown connectors have been used for many years in building structures to strengthen the joints of wood frame members to better withstand such cataclysmic forces such as earthquakes, hurricanes, tornadoes, and floods. One of the primary uses of holdowns is in connecting the frame of a building to the concrete foundation.

Early holdowns and even most holdowns in use today are formed so that there is a short but deleterious lateral distance between the load force applied by the held member and the resistance force applied by the holding member causing an eccentric loading. This eccentric loading applies a load multiplier effect which is directly related to the distance between the applied load and the resistance load. Such holdown are hereafter referred to as eccentric holdowns.

Within the past few years a form of holdown known as a concentric holdown has been developed. In a concentric holdown, the applied load and resistant load are on or as near as possible to the same axis. The holdown of the present invention is another form of concentric holdown.

A recent example of a concentric holdown is found in U.S. Pat. No. 6,513,290 granted to William F. Leek on Feb. 4, 2003.

The holdown of the present invention improves upon the prior art holdowns by providing a combination nut, washer, clamp, and tension force flow member, hereafter sometimes referred to as a combination member. The combination member serves as a nut for threadably engaging the end of the threaded anchor member as well as serving as a washer for transferring the load forces from the holdown connector seat to the anchor member.

But, the combination member of the present invention is more than simply a washer. Additionally, the combination members serves as a tension force flow director.

U.S. Pat. No. 4,603,531 granted to Nash Aug. 5, 1986 shows a threaded nut 26 which also serves as a washer, but the threaded nut 26 serves only as a clamp by means of a bolt 25 to a specially formed foundation plate 28 which in turn is connected to the foundation by anchor bolts 30. (See FIGS. 4, 6, and 9 of U.S. Pat. No. 4,603,531)

Referring to FIG. 3 of Nash, the sides of elongated nut 26 have no part in directing the flow of tension forces from the seat penetrated by opening 24 of mounting bracket 20 around the right angle bend to the upright members of mounting bracket 20 which hold wood vertical member 10.

Millions of sheet metal eccentric holdowns have been successfully used in building structures in the United States since they were first introduced in the late 1970's and became commonly used during the 1980's.

Both eccentric and concentric holdowns are attached to large column type members such as 4×4's or even tripled 2×4's.

The initial and primary purpose of both eccentric and concentric holdowns is to hold the weight of the building frame and the contents of the building and transfer these compression forces to the concrete foundation. The best way to transfer these large compression forces is to set the ends of the wood members on a flat metal plate or flat connector seat.

When an earthquake, hurricane or tornado strikes, the downward forces suddenly are reversed and an equally important purpose of both eccentric and concentric holdown members is to resist upward forces and to prevent the frame of a building from lifting off its foundation. It is here that the concentric holdowns are generally superior to the eccentric holdowns because the momentum forces are minimized.

But even eccentric holdowns must be carefully designed. The upward force in a prior art concentric holdown is initially resisted by the upright portion or straps of the concentric holdown connector which pull upwards on the outside edges of the flat holdown seat. These upward forces, if unrestrained, would quickly bend a prior art holdown connector seat into the shape of the letter "U" and crush the cross grain wood mud sill members when the weight of the building crashes back down on the mud sill resulting in failure of the connection and possibly leading to the destruction of the building.

Some work has been done to improve the flow of forces through holdown connector members from the held member to the foundation member. Holdowns such as U.S. Pat. No. 5,979,130 granted Nov. 9, 1999 to Gregg, Leek and Commins have been constructed with pre-bent concave seats and provided with U-shaped washers.

The problem with the U-shaped seat connector taught by U.S. Pat. No. 5,979,130, however, is the fact that they are problematical for resisting compression loads. The compression loads are exerted on a very small surface area which results in crushing the mud sill instead of being distributed over a large area.

To spread the compression bearing load in the present invention, the connector seat is not curved, but rather is flat to spread the bearing compression loads.

The flow of forces which move from the flat seat to the vertical members around nearly a right angle where the straps meet the connector seat requires a force flow director. Channeling forces through a right angle bend is clearly the worst possible condition. Failure of prior art holdown connectors is often at the right angle bend between the seat and the upright members or at the anchor bolt opening in the seat.

Applicant teaches a structure which directs the huge forces imposed by earthquakes and hurricanes to flow from the vertical members of the connector straps to the flat seat member in a smooth curvilinear stream.

Applicant cannot use a connector with a U-shape bend and an n-shaped washer as taught in Gregg et. al. in U.S. Pat. No. 5,979,130, because the combination member of the present invention must be rotated relative to the holdown connector to tighten down the combination member on the threaded anchor member in a clamping force against the seat of the holdown member. Gregg et. al.'s n-shaped washer cannot be rotated.

The n-shaped washers of Gregg et. Al in U.S. Pat. No. 5,979,130 are unusable in Applicant's concentric holdown because they are operational in only one specific orientation.

Holdowns which can withstand huge forces have found a growing use in structural shear wall panels such as the Simpson Strong-Wall Shear wall shown in Simpson Strongtie® connector catalog by Simpson Strong-Tie Company, Inc. catalog C-2002 pages 27, 30, and 31 and in Mueller U.S. Pat. No. 5,706,626, granted Jan. 13, 1998.

Mueller continued to use a standard nut, but did increase the thickness of the washer to withstand the greater loads. Mueller, however, teaches only the thick square washer and has virtually no curvature in his holdown connector which give the benefits of force flow control.

As evidence of the successful use of the compound curve force flow feature of the present invention, a destruction pull test of the connector of the present invention caused the holdown to fail in the strap portion at a point above the compound curve; not in the curved portion adjacent the seat.

The work done by others in the field to improve the ability of concentric holdowns to resist huge upward forces due to earthquakes and high winds such as hurricanes and tornadoes generally resulted in raising the held column member needlessly high above the foundation member. Applicant has labeled this increase in the height of holdowns, especially concentric holdowns as set forth above, as the "tower effect". The raising of the held column member or "tower effect", required the designers who built the U-shaped members and other lifting blocks to increase the length and thickness of the side straps to hold the columns in an upright position and to prevent them from bending over laterally.

This "tower effect" problem has been greatly alleviated by the use in the present invention of a combination member in which a single member, due to its internal threads, holds the combination member to the anchor member and serves as a nut while its large area serves as a clamping surface.

By eliminating sharp bends in the holdown connector member of the present invention and the use of compound bending through cold working of the metal, and directing flow of forces by means of the combination member, the problem of premature failure of the holdown member at the joinder of the upright straps to the flat seat member has been eliminated.

SUMMARY OF THE INVENTION

The present invention is a concentric holdown connection between a held building structural member and a holding building structural member using a holdown connector, a combination member, and an anchor member. The combination member serves the combined function of a nut, washer, clamp and together with the compound curve in the holdown connector serves as a tension force flow directing member.

The anchor member is held by and has a first end which protrudes above the holding building structural member. The first end of the anchor is received by the holdown connector, usually through an opening in a portion thereof called a seat. The threaded anchor bolt member is joined to the holdown connector by the threaded opening in the combination member. Load receiving portions of the holdown connector, such as straps, are integrally connected to the seat and are connected to the held building structural member by fasteners such as nails, bolts or screws.

The combination member has a base dimensioned and formed for engaging a substantial portion of the seat portion of the holdown connector and has a much greater thickness than the washers used in most holdown connectors and has a greater resistance to bending than standard washers. This bending resistance keeps the load evenly distributed over the base of the combination member and the seat of the holdown connector and more effectively transfers the load from the seat to the load receiving portions or straps fastened to the held building structural member.

Another important feature of the present invention is that by eliminating a separate washer, like the tall washer member shown in U.S. Pat. No. 6,513,290 the overall distance between the bottom end of the held structural member such as a stud or post, above the seat of the holdown connector can be greatly reduced, thereby reducing the "tower effect".

Primarily, the use of the combination member of the present invention reduces the distance between the bottom end of the held member such as a single or double 2×4 and the top of the seat member. This distance, sometimes referred to as the "tower effect", though short, is crucial because the strap members of the holdown connector of the prior art must be very heavy to prevent buckling due to very heavy downward forces imposed by earthquakes. Thus, the use of the combination member of the present invention permits the length of the portion of the holdown connector fastened to the held member to be shortened and the weight of the holdown connector to be reduced.

Part of the elevation distances, in prior art holdown connectors, may be shortened by predrilling bores in the end of the wood held member to receive the nut and anchor member, but this reduces the cross sectional area of the wood held member and thus the ability of the wood held member to resist large compression loads imposed in earthquake incidents.

Predrilled bores are also sometimes used in the present invention. But, the bore holes may be much smaller because the bore in the wood column need only accept the threaded bolt end; not the diameter of the nuts.

An even more important reason for reducing the stand off distance between the lower end of the wood frame member and the seat of the holdown member is to reduce the racking effect caused by earthquakes which impart horizontal forces. Applicant's found in watching tests of their holdowns on earthquake test machines that as horizontal loads were applied to the sides of the holdowns, that the straps of the holdowns tended to bend at the plane of the intersection of the bottom of the wood post member and the top of the washer member. Applicant's initial reason for designing the holdown of the present invention was to reduce this stand off distance. Applicant eliminated the tower effect by reducing the stand off distance, but achieved a higher load value which was quite unexpected. This unexpected result is discussed at the beginning of the description of the invention.

Another patent showing a high stand off distance is Wolfson U.S. Pat. No. 5,375,384. Providing stand off members, as shown in U.S. Pat. No. 5,375,384 granted to Wolfson in 1994, instead of drilling large bores in the held wood structural member solves the problem of drilling and weakening the wood held structural member in compression but increases the need to provide heavy walls in the standoff member to prevent buckling when the connection is subject to unusual compression forces as in earthquakes where the forces may be reciprocating vertical forces.

In the present invention, the entire threaded bore of the combination member may be filled with the threaded end of the connecting rod, leaving no voids within the combination member. Further, a substantial portion of the perimeter of the combination member is laterally tightly held by the upright portions of the holdown connector. Thus a substantial portion of the threaded anchor member and the holdown connector are tightly joined one to the other to prevent relative lateral movement of the holdown connector. In contrast, in all holdowns using standard nuts, there is always a space surrounding the threaded nut so that a tool may have room to turn the nut.

(See FIG. 13 of U.S. Pat. No. 6,513,290 supra.

Further, in the present invention, a major portion of the combination member provides a force path between the sides of the connector member and the anchor member. In contrast, there is no force path between the sides of the connector and the nut member in either U.S. Pat. No. 6,513,290 or U.S. Pat. No. 5,375,384 or any other holdown known to Applicant having a separate fastening nut attached to a threaded end of an anchor bolt. This feature of the present invention efficiently transfers vertical forces from the side straps of the holdown connector to the anchor member.

By providing a combination member which operates as a combined nut and washer, the reduction in number of parts contributes to an efficiency in manufacturing, storing, shipping and inventory and storage problems prior to installation. Having a single part contributes to installation efficiency in not have to look for lost parts.

A further object is to provide a connector which more efficiently withstands tension and compression forces than connectors of the prior art while remaining economical to produce and simple to install.

A further object of the present invention is to provide a base for the held building structural member that resists design compression loads.

A further object of the present invention is to provide a holdown connector that does not create eccentric loading. This is accomplished by setting the axis of the held structural member, such as a post, directly over the axis of the anchor bolt member.

The shape of the combination nut, washer, clamp, and tension force flow member of the present invention, also referred to as a combination member, may have a donut-like shape. Applicant has adopted the alternate spelling "donut" because it connotes the "threaded nut" function instead of the "doughnut" spelling which is the definition of an edible pastry.

Furthermore, the donut-like shape of applicants combination member has somewhat the shape of the doughnut tire which has the dictionary definition of a balloon tire, extra large in annular section and requiring very low air pressure. Like the doughnut tire which has a flat tread member, applicant's donut combination member may, but not necessarily, have a flat annular band at its mid point and flat upper and lower surfaces; rather than being a true torus which has a true circular annular cross section.

The donut-like shaped combination member of the present invention must be rotated on the threaded anchor member and must be operational in all rotational orientations of the donut member.

Applicant has bent the holdown member to be in close registration with the curvature of the donut-like combination member on both radial axes; viz. the radius normal to the axis of the donut, and the radius concentric with the axis of the donut. Thus the curvature of the holdown connector in the strap adjacent to the flat seat member is a compound curve. In sharp distinction, the curvature of the U-shaped connector shown in U.S. Pat. No. 5,979,130 is merely a simple curve.

As proof of the efficacy of the compound curve force flow feature of the present invention, a destruction pull test of the connector of the present invention caused the holdown to fail in the strap portion at a point above the compound curve; not in the curved portion adjacent the seat.

A feature of the present invention is the fact that deflection of the holdown connector is minimized during design uplift loads. The unexpected ability of the holdown connector to resist deflection under upward loads is thought to be due in part to the cold form bending of the holdown into the compound curve discussed above. Cold form bending hardens the steel and thus makes the steel more resistant to unbending during upward loads. Thus deflection is decreased and pursuant to many building code requirements, greater loads on the holdown connector may be achieved before the code dictated deflection occurs.

Another object of the present invention is to provide a holdown connector which can be used with metal pipe held members with very little modification of the holdown connector used with wood held members Other advantages of the present invention are set forth in this specification.

These and other objects of the present invention will become apparent with reference to the drawings, the description of the preferred embodiment and the claims.

DESCRIPTION OF THE PREFERRED EMBODIMENTS

Figure 1:
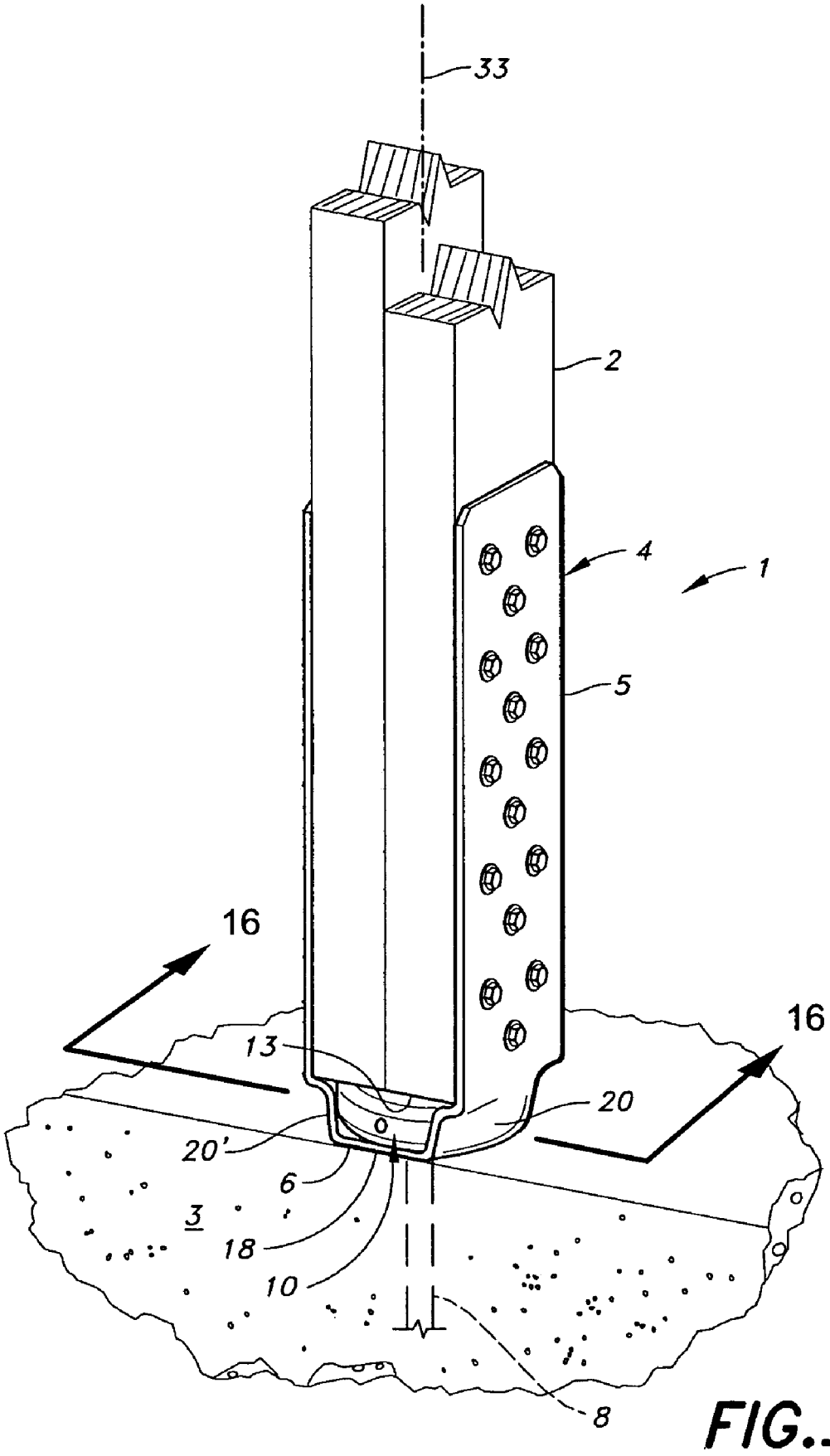
FIG. 1 is a perspective view of the concentric holdown connection of the present invention. A held building structural member is fastened to a holdown connector which in turns is connected to a holding structural member by an elongated anchor member.

As stated in the background of the invention above, Applicant's initial purpose in providing the donut combination member was to reduce the stand off distance of the bottom of the wood column member above the seat of the holdown member; the so called "tower effect". This objective was reached, but a much more unexpected achievement was obtained; viz., the concentric holdown connection was able to achieve a much higher load value.

To understand this achievement, it must first be understood that load ratings of holdown members in some jurisdictions such as Los Angeles, Calif. which is an elevated risk earthquake area, are based on the load that can be held before the sheet metal connector elongates in the direction of the load force or deflects ¼". Applicant found that his concentric holdown using the donut combination member in a 7 gauge holdown with straps was able to achieve a load of 45,030 pounds before exceeding the 0.025" deflection criteria. This was more than twice the load achieved by similar holdowns but using square block washer members instead of the donut-like combination member of the present invention. Moreover, the ultimate load at failure was 51,839 pounds. Thus, with the safety factor of 2.5, the load was 17,266 pounds for the present holdown.

The test holdown had an obround opening in the seat which measured 1" by 11.4". With such a large opening, applicant expected the seat to fail at the large opening. Instead, failure occurred in one of the strap members at a point well above the donut-like combination member.

The reason for these unexpected results are unknown, but the structure of the holdown suggests three factors may play an important role.

First, Applicant used a bend radius of ⅜" instead of the usual ¼" bend radius in similar holdowns. This certainly could be a factor in achieving a higher load, but a ⅛" difference in bend radius is not all that much and does not explain the unexpectedly high load rating. Bending metal at too sharp an angle sets up stresses in the metal where failure often occurs. Further, forces flow around large radius bends much easier than around sharp bends.

The larger radius tends to partially explain the high ultimate load, but does not explain the high load achieved before the critical 0.025" deflection occurred.

It is believed that two factors may assist in explaining the high loads achieved before the critical deflection occurs. First, not only is the donut-like combination member perfectly mated to the holdown seat, but perhaps more importantly, because of the near non bendable nature of the donut-like combination member, an almost perfectly even clamping or loading is applied to the nearly total seat area of the holdown member. Thus, practically no deflection occurs in the seat member of the holdown.

A second factor in the holdown achieving a very high loading before the critical deflection occurs is the compound curve that is formed in the holdown. To form the holdown connector, a donut-like forming member, identical in size and shape as the donut-like combination member, is placed on the seat of the holdown and a hammer or a press, deforms the metal in the holdown member around the donut-like forming member. Obviously some cold working of the metal occurs in the process of forming of the metal around the donut-like forming member which renders the metal in the holdown member harder and much more difficult to straighten out once the compound curve has been formed in the metal.

Not only does the cold working of the metal increase resistance to bending under loads, but also the very shape of the metal formed in a compound curve contributes to the resistance of the metal to deflect and stretch under earthquake type loads.

Amazingly, in reviewing the holdown of the present invention, which was tested to failure, no stretching or straightening of the compound curve in the metal around the donut combination member is visible. There is considerable visible evidence of stretching of the metal in the strap member above the donut combination member. One can see that the round fastener holes in the strap at the point of failure have been stretched to an obround shape from their perfectly circular shape.

Thus an important objective of the present invention is to achieve high load resistance with minimal deflection.

BRIEF DESCRIPTION OF THE INVENTION

As shown in the drawings as in FIG. 1 for example, the concentric holdown connection 1 of the present invention for joining a held building structural member 2 having a bottom end surface 13 to a holding building structural member 3 consists of a holdown connector 4 having at least one first upright portion 5 operably connected to the held building structural member 2 and which is integrally joined to a seat portion 6 having an opening 7 therethrough; an elongated anchor member 8 operably joined to the holding building structural member 3 and having a threaded end portion 9 dimensioned for insertion through the opening 7 in the seat portion 6; and a combination nut, washer, clamp, and tension force flow member 10, also known as a combination member, formed with a threaded opening 11 for threadably receiving the threaded end portion 9 of the elongated anchor member 8 and having a base 12 dimensioned and formed for engaging substantially the entire area of the seat portion 6. Further, the combination member 10 has a form and thickness for providing rigidity to minimize deflection of the seat portion 6 at selected design loads and to minimize elevation of the held building structural member 2 above the building structural holding member 3, and to maximize the cross sectional bearing area of the bottom end surface 13 of the heLd building structural member 2.

In one form of the invention, the bottom end 3 of the held building structural member 2 need not rest on the combination member 10.

As used in this specification, the word "concentric" has the usual dictionary meaning; namely; having a common axis.

Concentric holdowns may include holdowns with two strap members as shown in the drawings. Concentric holdowns may also include holdowns having only one upright member. Such holdowns included elements such as pipes or sleeves having a circular or circular like shape, polygonal in cross section having a plurality of sides joined together but not necessarily forming an enclosed member or some other configuration which provided a concentric holdown connection. The pipe or other holdown connector should preferably have an inspection opening so that a building inspector or other person could determine whether the holdown connector had been correctly installed.

In probably the most common form of the invention as envisioned, the held building structural member 2 is formed with a bottom surface 13; the combination member 10 is formed with a top surface 14 for engaging a substantial portion of the bottom surface 13 of held building structural member 2.

In this form of the invention, the combination member 10 serves as a compression member with the held building structural member resting directly on the combination member 10. The combination member 10 is preferably made of steel or other material which can withstand the huge compressive forces. Preferably the combination member 10 is solid, or nearly solid. Where weight is an important factor, the combination member 10 could be perforated or structurally formed to withstand large compressive loads.

In another form of the invention, combination member 10 is dimensioned, and elongated anchor member 8 is dimensioned and set in the concrete form at a selected elevation so that the threaded end portion 9 does not protrude above the top surface 14 of the combination member 10. By not protruding above the top surface 14, the bottom surface 13 of the held building structural member 2 may rest directly on the top surface 14 of the combination member 10 and thus avoid the "tower effect" of needlessly supporting the bottom surface 13 of the held building structural member 2 at an elevation higher than needed above the seat of the holdown connector 4

In another form of the invention, the bottom surface 13 of the held building structural member 2 is penetrated by an axial bore 15 for receiving threaded end portion 13 of elongated anchor member 8 but bottom surface portion 13 of held building structural member 2 does not rest on combination member 10. Bolts or screws 31 inserted through openings 40 in strap members 5 and 5' hold building structural member 2 above combination member 10.

By eliminating a separate washer, the overall distance between the bottom end of the held structural member such as a stud or post, above the seat of the holdown connector can be reduced by at least the thickness of a washer such as the washer shown in Leek, U.S. Pat. No. 6,513,290. The length of the portion of the holdown connector fastened to the held member can be shortened but primarily, the combination washer and nut of the present invention, herein sometimes referred to as combination member 10, reduces the laterally unsupported distance in concentric holdown connectors between the bottom end of the held member such as a single or double 2×4 and the top of the seat member. This distance, referred above as the "tower effect", though short, is crucial because the side walls of the holdown connector must be very heavy to prevent buckling due to very heavy downward forces imposed by earthquakes.

Figure 3:
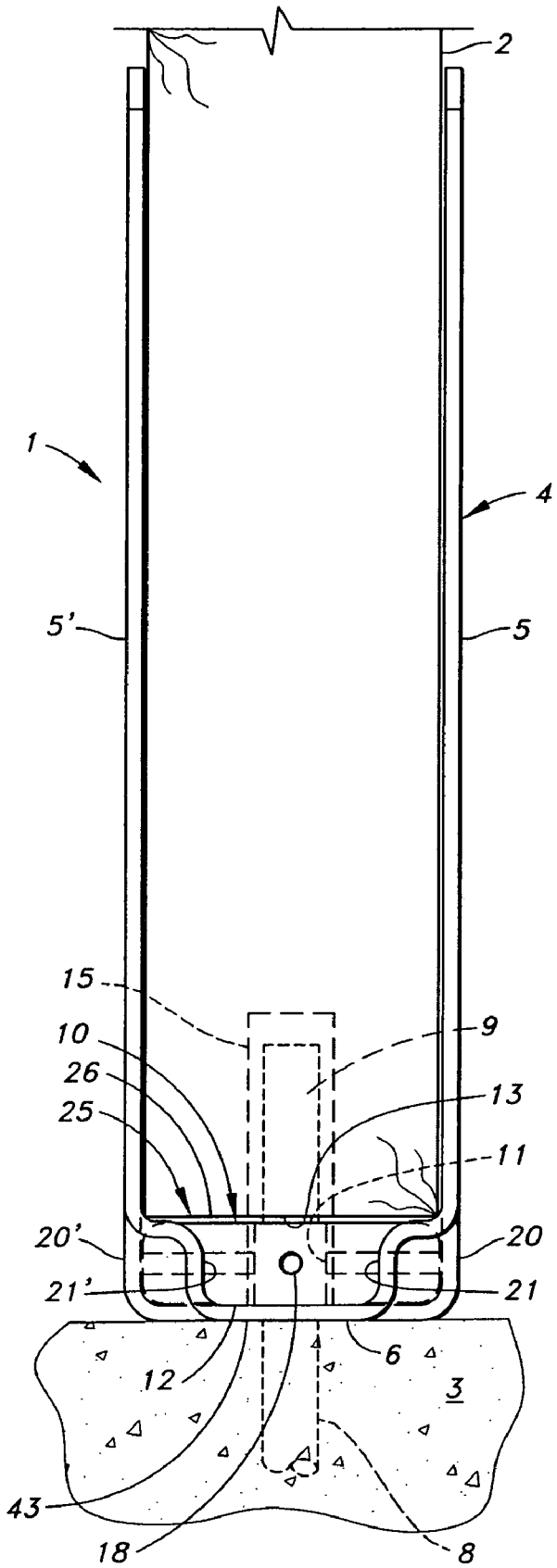
FIG. 3 is a front elevation view of the concentric holdown connection illustrated in FIG. 1. The single phantom lines indicate the location of the lateral bores and the double phantom lines indicate the location of the threaded axial bore in the combination member. The outline of the combination member hidden behind the connector member is shown by dashed lines. The dashed lines in the portion of the foundation illustrate the location of the threaded anchor member.
Figure 4:
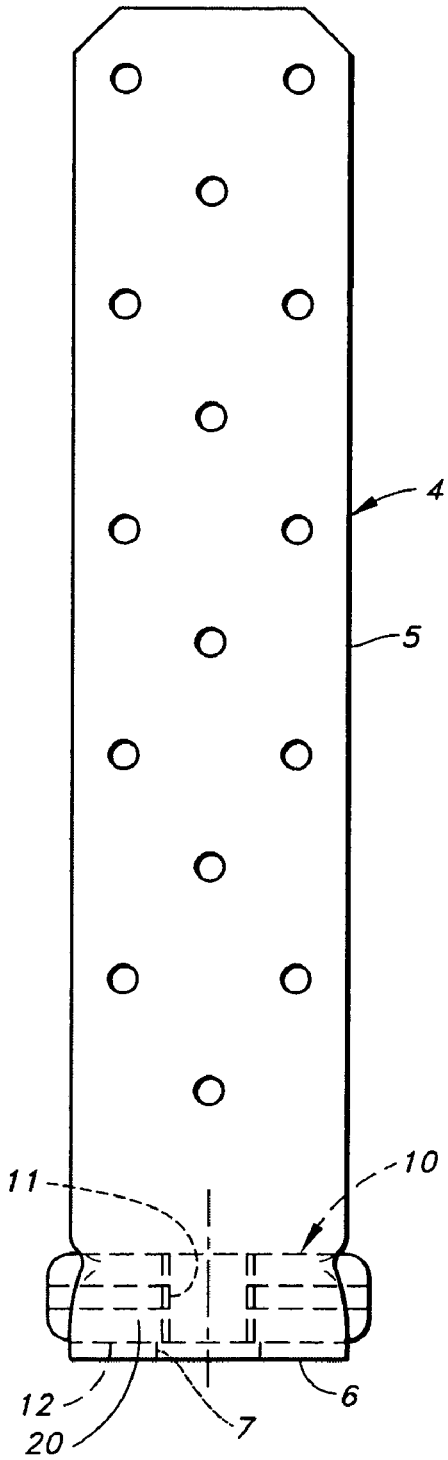
FIG. 4 is a side elevation view of the holdown connector illustrated in FIG. 2. The combination member is shown in a seated position. The hidden portion of the combination member is illustrated in dashed lines. The single phantom lines indicate the location of the lateral bores and the double phantom lines indicate the location of the threaded axial bore in the combination member.
Figure 5:
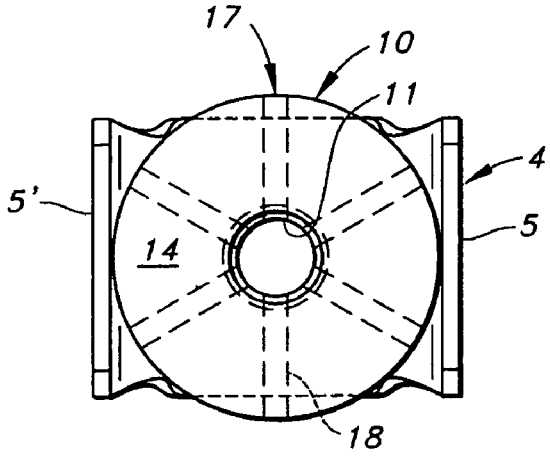
FIG. 5 is a top plan view of the holdown connector illustrated in FIG. 2 showing the combination member in a seated position.

In another form of the concentric connection holdown 1 as illustrated in FIG. 3, the bottom surface 13 of the held building structural member 2 is penetrated by an axial bore 15 for receiving the threaded end portion 9 of the elongated anchor member 8.

In this form of the invention, the elongated anchor member 8 extends through the threaded opening 11 in combination member 10 and into the axial bore 15 in held structural building member 2. The bottom surface 13, of the end of the held member 2 preferably rests on the top surface 14 of combination member 10.

Figure 2:
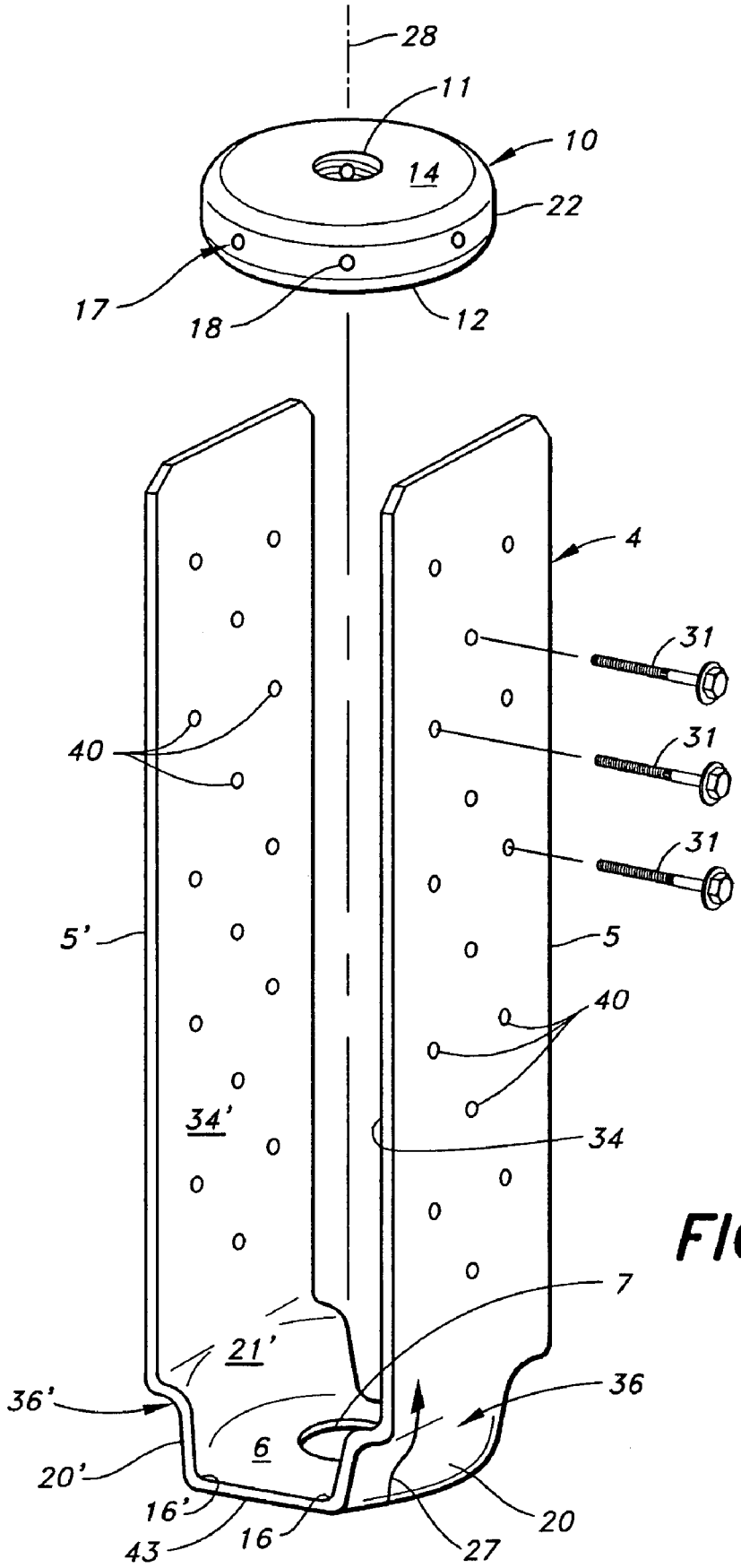
FIG. 2 is an exploded perspective view of the holdown connector illustrated in FIG. 1.
Figure 6:
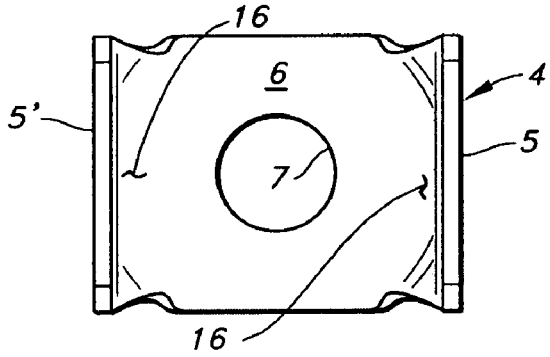
FIG. 6 is top plan view of the holdown connector shown in FIG. 2 with the combination member removed.
Figure 8:
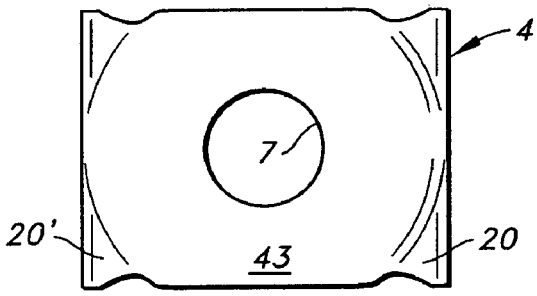
FIG. 8 is a bottom plan view of the holdown connector shown in FIG. 7.
Figure 7:
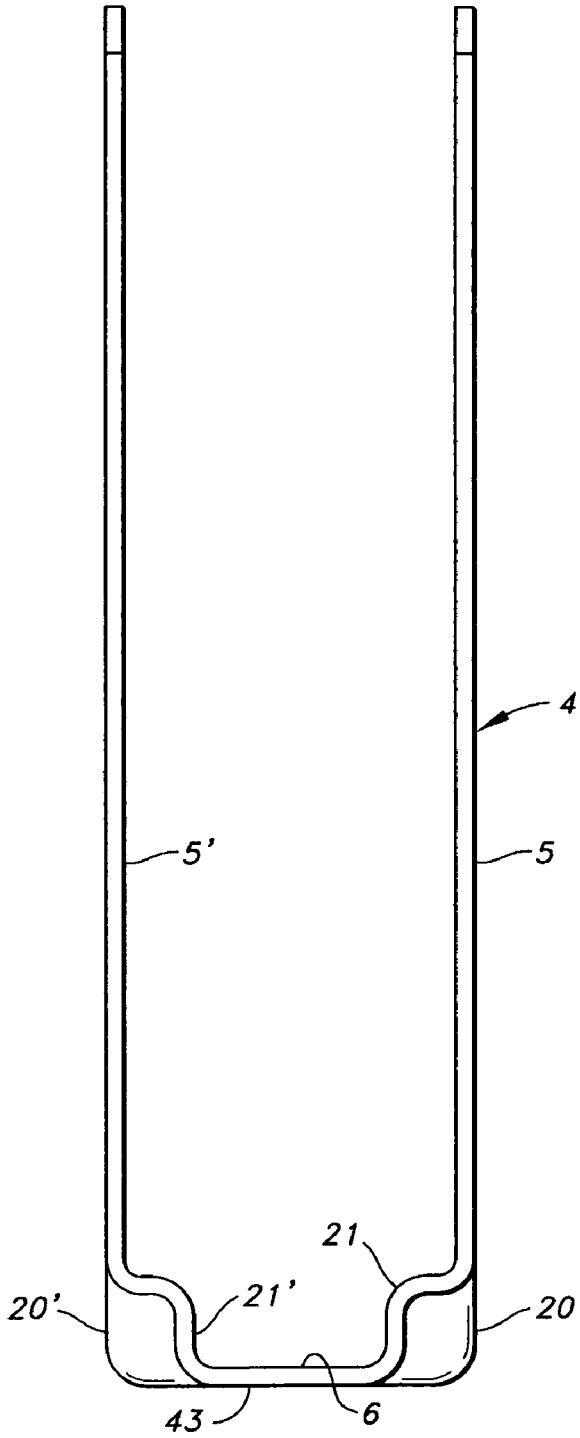
FIG. 7 is a front elevation view of the holdown connector shown in FIG. 2 with the combination member removed.

Referring to FIGS. 1, 2 and 6, in the preferred form of the concentric holdown connection 1, the holdown connector 4 has first and second laterally spaced upright portions 5 and 5' operably connected to the held building structural member 2 and which are integrally joined to opposite edges 16, and 16' of the seat portion 6.

In another form of the concentric holdown connection 1 the combination member 10 is circular like. It may be a near perfect circle, or it could have a multifaceted perimeter with the intersections of the faces forming a circle. It is important that there be sufficient faces so that at any position of the combination member 10, at least three intersection points should be in contact with the inner sides of the upright portions 5 of the holdown connector 4.

Since the combination member 10 must serve as a threaded nut there must be some form of tool for rotating it on the threaded portion of the elongated anchor member 8. The combination member is formed with a configuration 17 for engaging a tool capable of rotating combination member 10.

The configuration 17 may be formed in the top surface 14 of the combination member 10 or in the circumferential perimeter side edge wall 22 of combination member 10.

Combination member 10 may be formed with at least one recess 18 formed and dimensioned for receiving a tool capable of rotating the combination member 10. Recess 18 may be a plurality of circular bores formed in either the top surface 14 or the circumferential perimeter side edge wall 22 of combination member 10. A bolt or tool with a mandrel formed and dimensioned for insertion into the recess 18 could be used to rotate the combination member 10.

Figure 9:
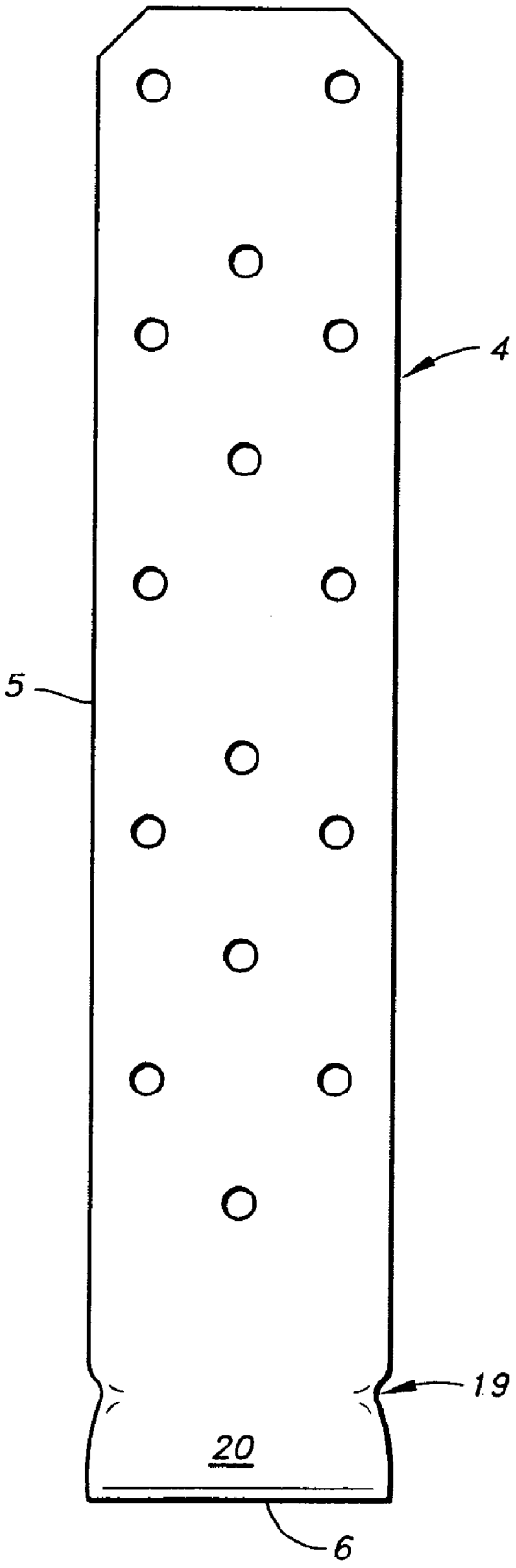
FIG. 9 is a side elevation view of the holdown connector of FIG. 2 with the combination member removed.
Figure 10:
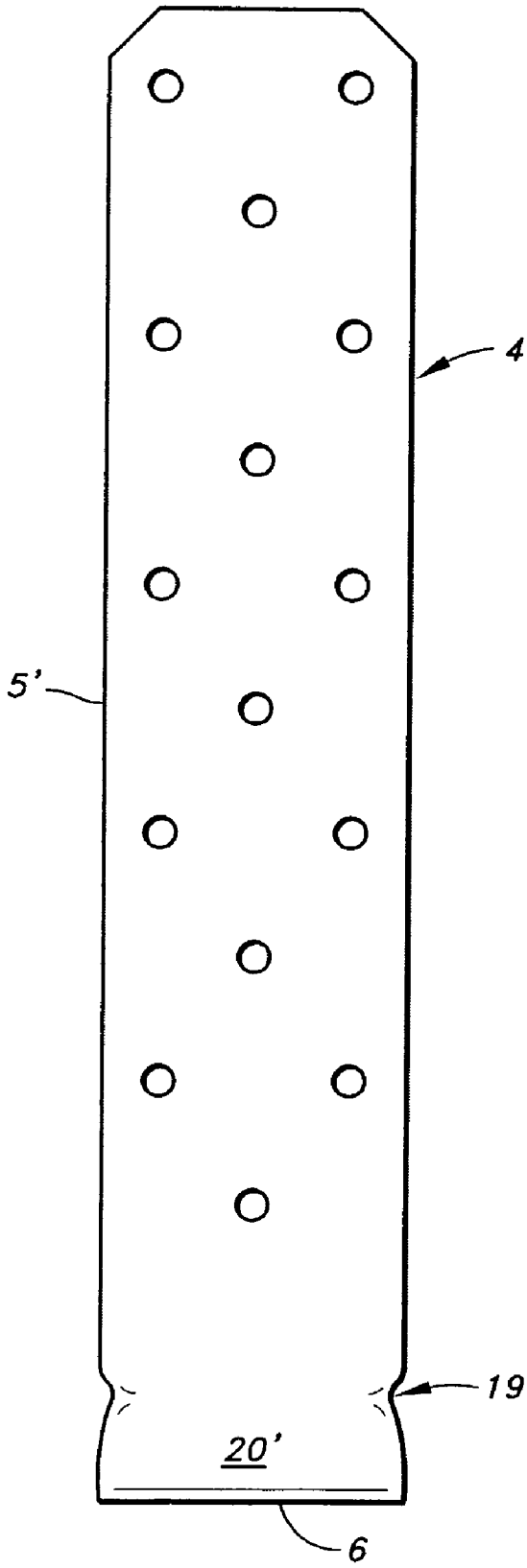
FIG. 10 is a side elevation view of the opposite side of the holdown connector illustrated in FIG. 9.
Figure 11:
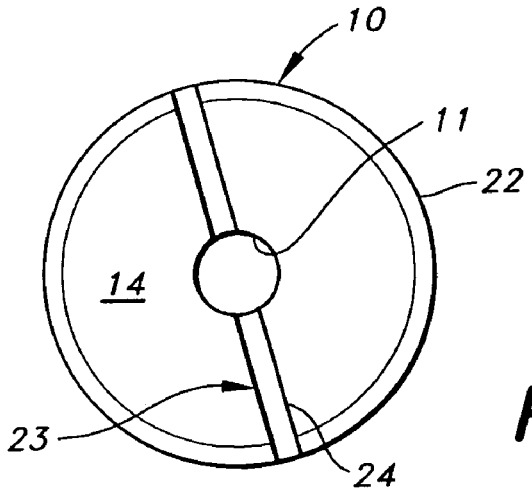
FIG. 11 is a top plan view of the combination member shown in FIG. 2.

Preferably holdown connector 4 has two laterally spaced upright portions 5,5' operably connected to held building structural member 2 and which are integrally joined to opposite edges 16, 16' of seat portion 6. As shown in FIGS. 9 and 10, holdown connector 4 is formed with stop limit means 19, here shown e.g. as indentations in upright portions 5, 5' of holdown connector 4, for engaging combination member 10 for aligning opening 11 in combination member 10 with opening 7 in seat portion 6.

In another form of the concentric holdown connection 1 previously described and as best illustrated in FIG. 2, holdown connector 4 has first and second laterally spaced upright portions 5, 5'; which may be also referred to as strap members, which are operably connected to held building structural member 2 and which are integrally joined to opposite edges 16, 16' of seat portion 6. Formed portions 20, 20' of first and second upright portions or strap members 5, 5' adjacent seat portion 6 are deformed inwardly so as to form engagement surfaces 21 and 21' for engaging the circumferential perimeter side edge wall 22 of combination member 10 at least at three points for substantially centering threaded opening 11 in combination member 10 with opening 7 in seat portion 6 of holdown connector 4, and for stiffening upright portions 5, 5' to prevent deflection under load.

In some jurisdictions, building codes require that holdowns be constructed so that inspectors may visually check that nuts are installed correctly on the threaded anchor bolts. In the present concentric holdown connection described above, inspection means 23 for determining the selected threaded engagement of threaded end portion 9 of elongated anchor member 8 with combination member 10 is provided.

One form of inspection means 23 may be a groove 24 formed in combination member 10 coincident with a portion of threaded opening 11.

Another form of inspection means 23 for a concentric holdown connection 1 as described may include providing a plastic plate member 25 in registration with top surface 14 of combination member 10 formed with a translucent portion to enable inspection to determine that threaded end portion 9 of elongated anchor member 8 is properly installed in threaded opening 11 of combination member 10.

Donut

Figure 12:
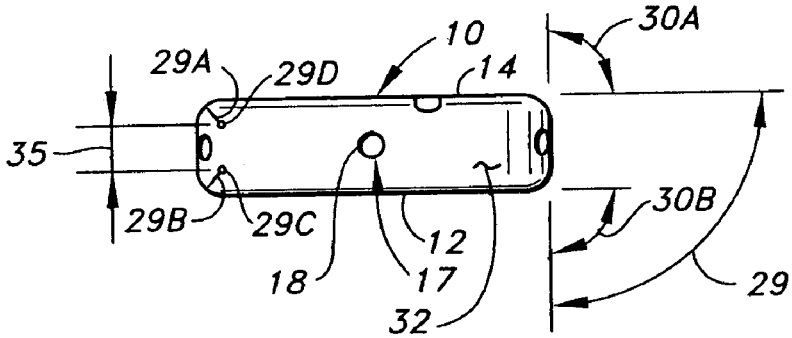
FIG. 12 is a front elevation view of the combination member shown in FIG. 11.

A preferred form of the concentric holdown connection 1' as previously described includes a combination nut, washer, clamp, and tension force flow, hereafter combination member 10 which has a donut-like configuration as illustrated in FIGS. 11-14. In one form of the donut-like configuration as illustrated in FIG. 12 combination member 10 includes a circumferential perimeter side edge wall 22 which includes a generally flat annular band 35. Circumferential perimeter side edge wall 22 could be curved about an axis normal to axis 28, but as shown in the drawings, the circumferential perimeter side edge wall 22 includes a generally flat annular band 35 between large radius upper curved edge portion 30A and large radius lower curved edge portion 30B.

In the preferred form, concentric holdown connection 1 includes held building structural member 2 which is formed with a bottom surface 13; and combination member 10 is formed with a top surface 14 for engaging a substantial portion of bottom surface 13 of held building structural member 2.

In another preferred form, concentric holdown connection 1 as previously described is constructed so that bottom surface 13 of held building structural member 2 is penetrated by an axial bore 15 for receiving threaded end portion 9 of elongated anchor member 8.

In still another form of a concentric holdown connection 1, held building structural member 2 is formed with a bottom surface 13, and bottom surface 13 of held building structural member 2 is penetrated by an axial bore 15 for receiving threaded end portion 9 of elongated anchor member 8.

It is to be noted that in this form of the invention, the bottom surface 13 of held building structural member 2 is held above the top surface 14 of combination member 10 by fasteners 31 inserted through openings 40 in upright portion 5.

In the preferred form of concentric holdown connection 1, holdown connector 4 has first and second laterally spaced upright portions or straps 5, 5' operably connected to held building structural member 2 and which are integrally joined to opposite edges 16, 16' of seat portion 6. Upright portions 5 and 5' may be joined to held building structural member 2 by fasteners 31.

In concentric holdown connection 1 in which combination member 10 has a donut-like shape (hereafter, donut shape), the peripheral side edges 32 of combination member 10 are formed with a configuration 17 for engaging a tool capable of rotating combination member 10.

Figure 13:
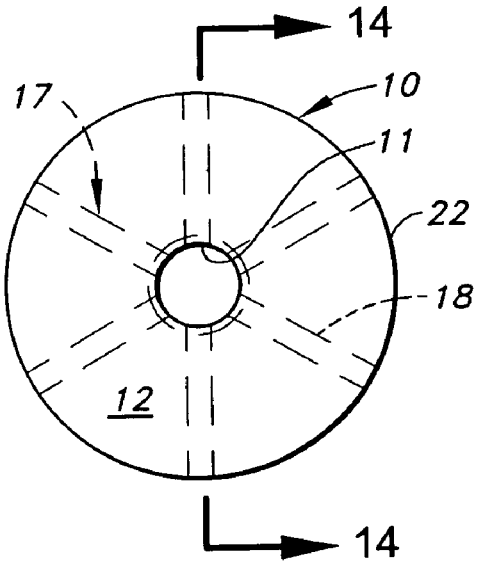
FIG. 13 is a bottom plan view of the combination member illustrated in FIG. 12 with the radial bores shown in phantom line. The phantom line around the axial bore indicates that the axial bore is threaded.
Figure 14:
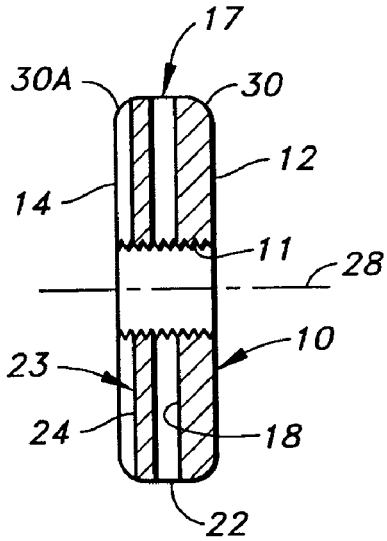
FIG. 14 is a cross sectional view of the combination member taken along line 14-14 in FIG. 13.
Figure 15:
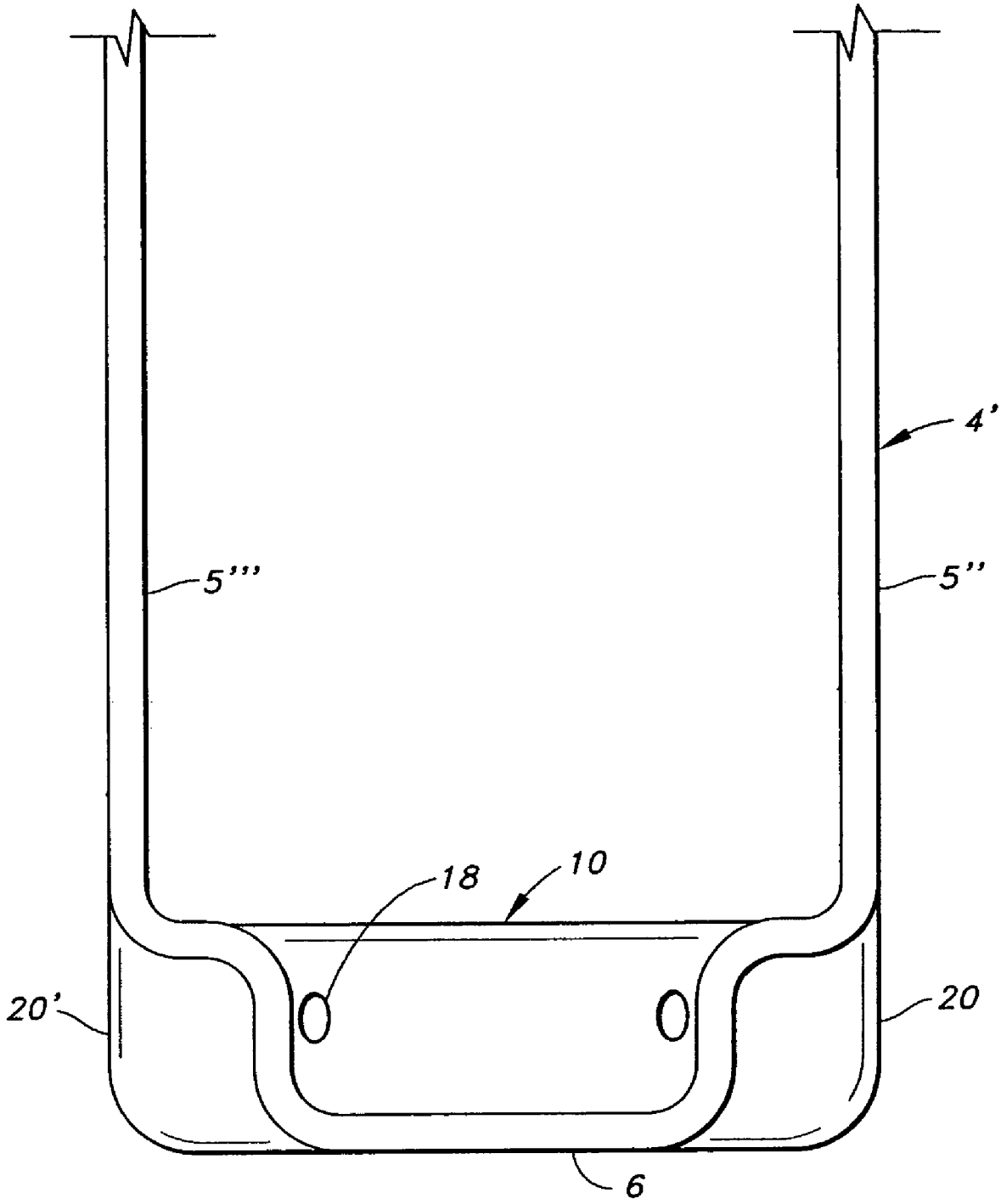
FIG. 15 is an enlarged front elevation view of a portion of the holdown connector illustrated in FIG. 2 with the combination member in a seated position.

One form of configuration is shown in FIGS. 13 and 14, but various configurations could be made, such as, openings in the side edge of combination member 10, as shown, or configurations in the top surface 14. Configuration 17 need not be limited to bores, but may also include other shaped indentations or surface protrusions.

As shown in the drawings of concentric holdown connection 1 in which combination member 10 has a donut like shape, combination member 10' is formed with at least one recess 18 formed and dimensioned for receiving a tool capable of rotating combination member 10. Recess 18 is preferably a ring of bores formed or drilled into the peripheral side edge of combination member 10'. The bores 18 may be dimensioned to receive a bolt or tool which has sufficient length to turn the combination member 10 so that it fits tightly on the threaded end portion of elongated anchor member 8.

Preferably the tool for turning combination member 10 is not a special tool, but rather the bore 18 should be designed so that a large nail or bolt can be inserted therein.

In one form of the concentric holdown connection 1 having a combination member 10 having a donut like shape, holdown connector 4 preferably has two laterally spaced upright portions 5 and 5' operably connected to held building structural member 2 and which are integrally joined to opposite edges 16 and 16' of seat portion 6. Holdown connector 4 may be formed with stop limit means 19 for engaging combination member 10' for aligning opening 11 in combination member 10 with opening 7 in seat portion 6.

In a preferred form of concentric holdown connection 1 having a combination member 10 shaped like a donut, holdown connector 4 has first and second laterally spaced upright portions 5 and 5' operably connected to held building structural member 2 and which are integrally joined to opposite edges 16 and 16' of seat portion 6.

Cold formed work hardened portions 20 and 20' of first and second upright portions 5 and 5' adjacent seat portion 6 which are deformed inwardly so as to form engagement surfaces 21, and 21', engage a substantial portion of the circumferential perimeter side edge wall 22 of combination member 10 for any rotational position of combination member 10. Work hardened portions 20 and 20' substantially center threaded opening 11 in combination member 10 with opening 7 in seat portion 6 of holdown connector 4.

More importantly the configuration of cold formed work hardened portions 20 and 20' transfers load forces 27 along a curved path from first and second upright portions 5 and 5' to seat portion 6 which is positioned at a substantially right angled plane to upright portions 5 and 5'.

Another important function of combination member 10 is to provide substantial reinforcement to upright portions 36 and 36' adjacent seat portion 6 to prevent upright portions 5 and 5' from pinching together under large uplift loads and from buckling under large down loads caused by earthquakes or other cataclysmic events.

As shown in FIGS. 1 and 2, cold formed work hardened portions 20, and 20' of first and second upright portions 5 and 5' adjacent seat portions 6 are formed to be in close registration with a substantial portion of circumferential perimeter side edge wall 22 of combination member 10. Circumferential perimeter side edge wall 22 may be formed with a planar band 35 as shown or it may be curved.

As shown in FIG. 12, generally flat annular band 35 of circumferential perimeter edge wall 22 of combination member 10, is located between large radius upper curved edge portion 30A and large radius lower curved edge portion 30B. Large radius lower curved edge portion 30B is generated by radius line 29B pivoted about point 29 C. Large radius lower curved edge portion 30A is generated by radius line 29A pivoted about point 29D.

By closely holding the tolerances of the cold formed work hardened portions 20 and 20' a frictional engagement lock may be achieved with combination member 10.

A major objective of the present invention is to provide a concentric holdown connection 1 with a minimum of seat deflection.

To achieve minimum deflection, combination member 10 is formed, dimensioned and designed with materials to have near zero design deflection within ultimate design loads exerted on concentric holdown connection 1.

Minimum deflection in the preferred form of the concentric holdown connection 1 of the present invention for joining a held building structural member 2 to a holding building structural member 3 is also achieved by designing the concentric holdown connection 1 to include a holdown connector 4 having at least two upright strap members 5, and 5', having inner side faces 34 and 34', operably connected to held building structural member 2 and each of which have lower end portions 36 and 36' integrally joined to opposed sides of a seat member 6 which is formed with an opening 7 therethrough.

Elongated anchor member 8 is operably joined to holding building structural member 3 and has a threaded end portion 9 dimensioned for insertion through opening 7 in seat member 6.

A combination member 10 having a donut-like configuration formed with a threaded opening 11 therethrough is positioned on the concentric axis 28 of combination member 10, and has a base 12 dimensioned and configured for continuous face to face registration with seat portion 6 extending from an area closely adjacent the periphery of opening 7 continuously to engagement surfaces 21 and 21' of inner side faces 34 and 34' of both upright strap members 5 and 5' and engages a substantial portion of seat 6.

In the preferred concentric holdown connection 1, base 12 of combination member 10 is preferably generally planar, and combination member 10 is formed with a top surface 14 adapted for engagement with a bottom surface 13 of said held building structural member 2.

Combination member 10 is preferably formed with a large edge radius curve 30B forming a compound curved circumferential edge wall 29 in combination member 10; and lower end portions 36 and 36' of upright strap members 5 and 5' are cold formed to a work hardened compound curved configuration 20 and 20' in matching registration with compound curved circumferential edge wall 29 in combination member 10.

Construction of the concentric holdown connector 4 in the foregoing manner, reduces further bending as the holdown connector 4 comes under load from an earthquake or other cataclysmic event. In so doing the present invention can meet building codes in jurisdictions which have restrictions on the amount of deflection that can occur.

Referring generally to FIGS. 15-25B, two other alternate forms of the invention are shown and described below.

Figure 17:
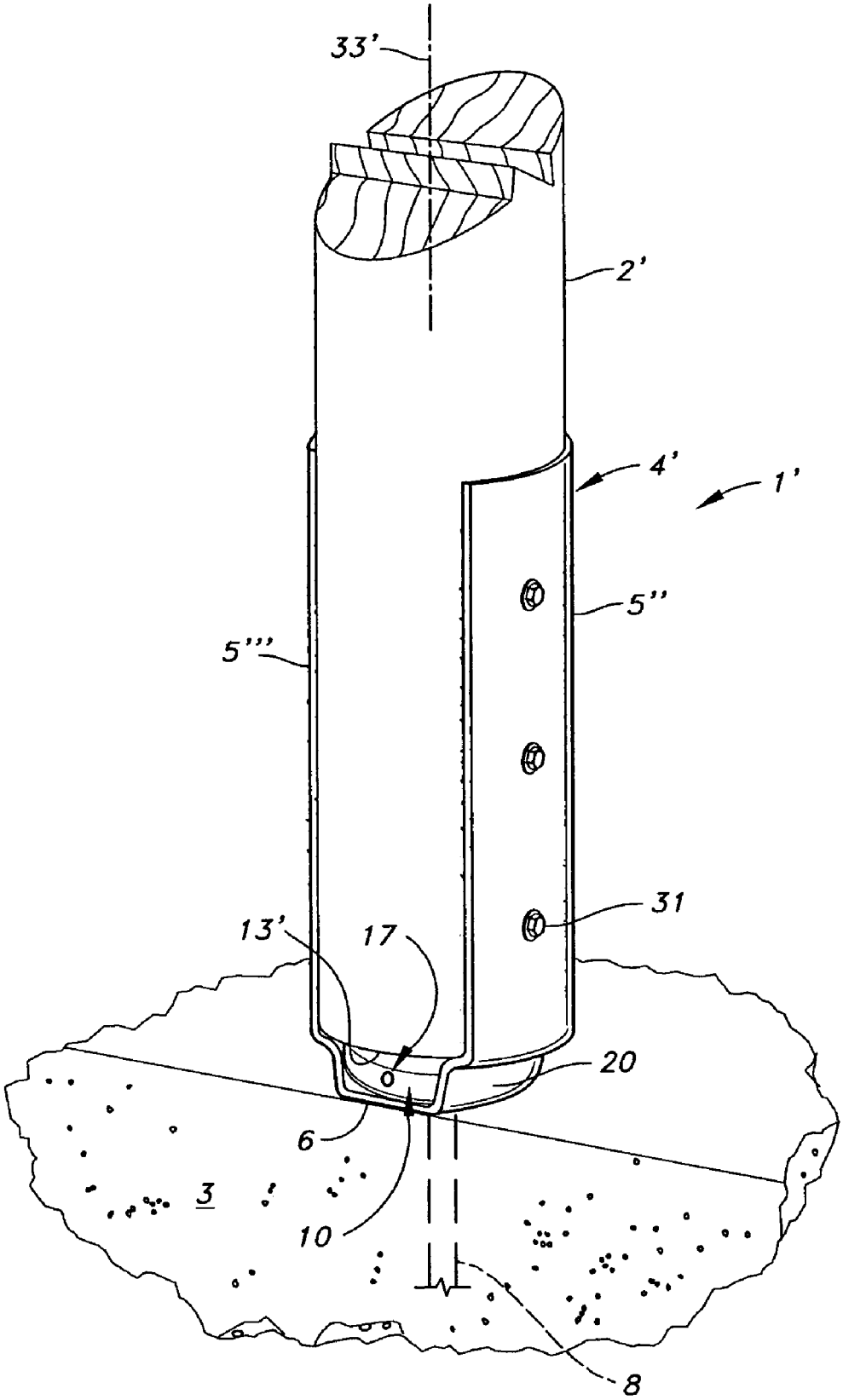
FIG. 17 is an elevation view of another form of the concentric holdown connection of the present invention shown in perspective.
Figure 18:
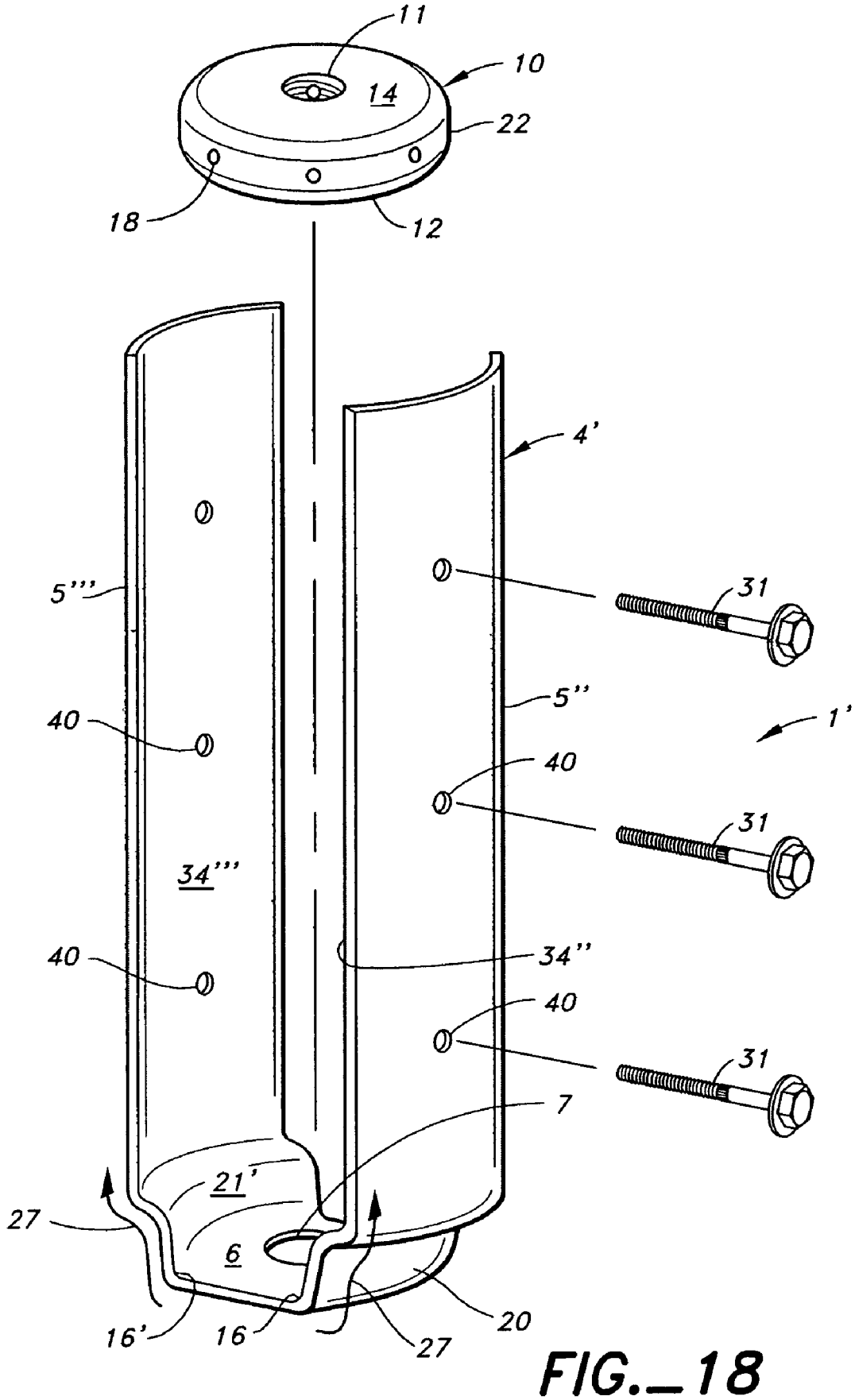
FIG. 18 is an exploded elevation perspective view of the holdown connector illustrated in FIG. 17.
Figure 19:
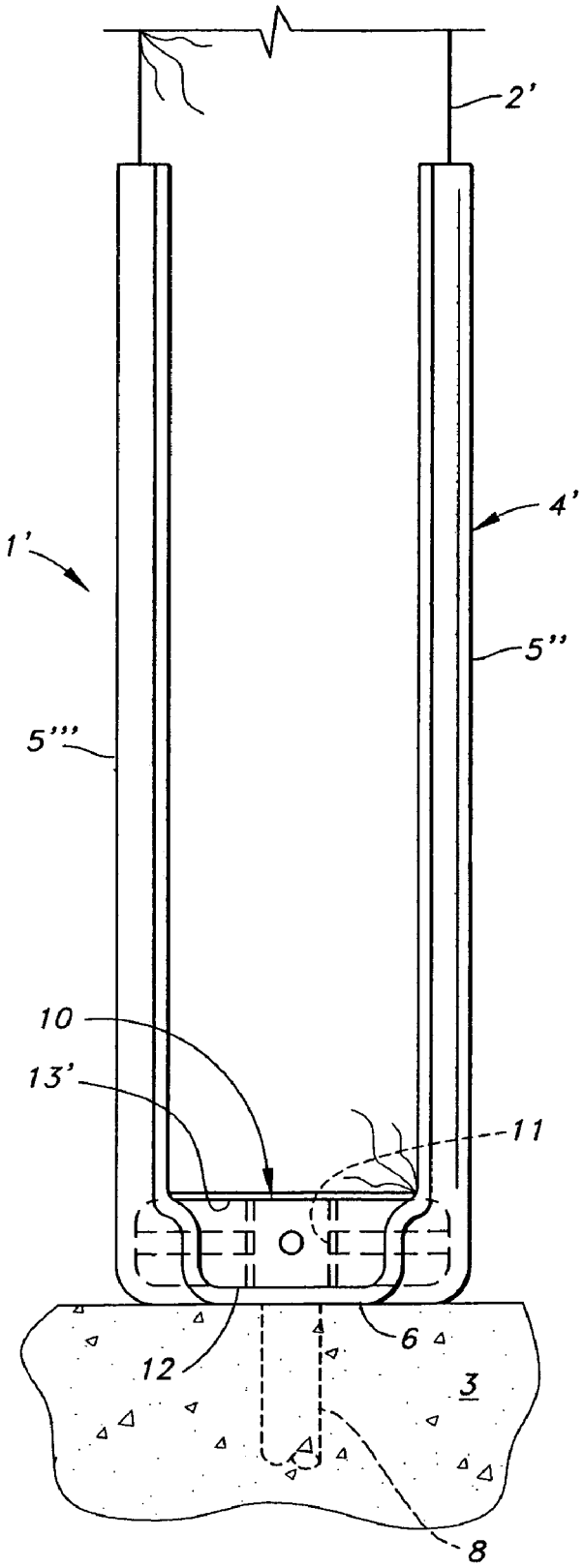
FIG. 19 is a front elevation view of the concentric holdown connection illustrated in FIG. 17. The single phantom lines indicate the location of the lateral bores and the double phantom lines indicate the location of the threaded axial bore in the combination member. The outline of the combination member hidden behind the connector member is shown by dashed lines. The dashed lines in the portion of the foundation illustrate the location of the threaded anchor member.
Figure 20:
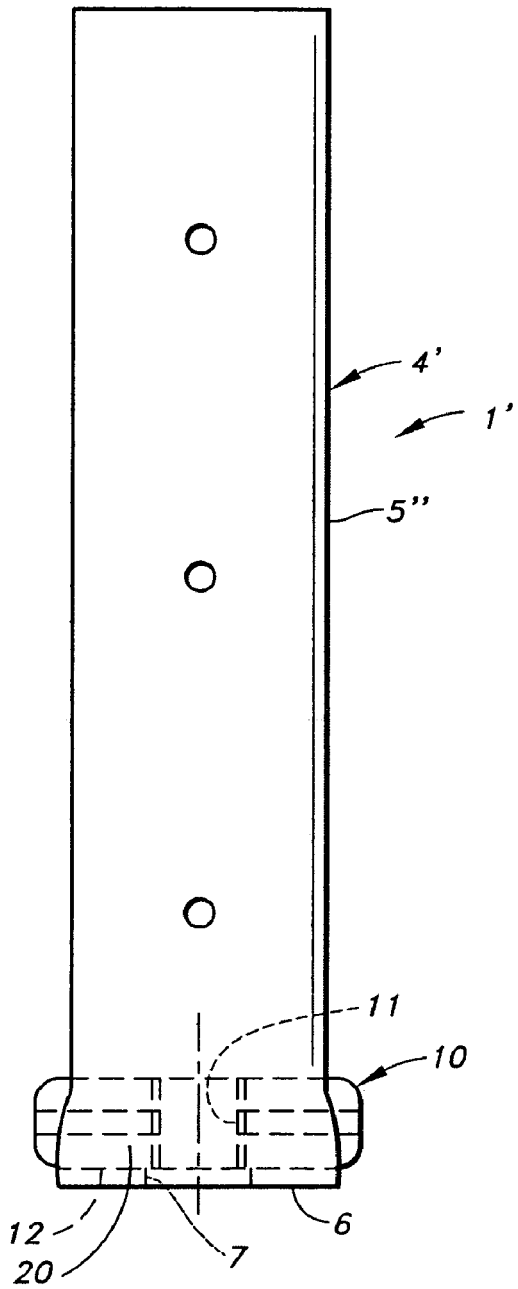
FIG. 20 is a side elevation view of the holdown connector illustrated in FIG. 18. The combination member is shown in a seated position. The hidden portion of the combination member is illustrated in dashed lines. The single phantom lines indicate the location of the lateral bores and the double phantom lines indicate the location of the threaded axial bore in the combination member.
Figure 21:
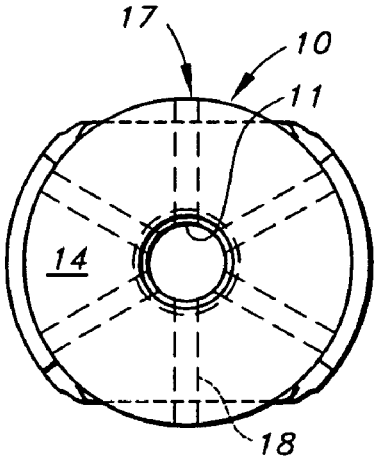
FIG. 21 is a top plan view of the holdown connector illustrated in FIG. 18 and showing the combination member in a seated position.
Figure 22:
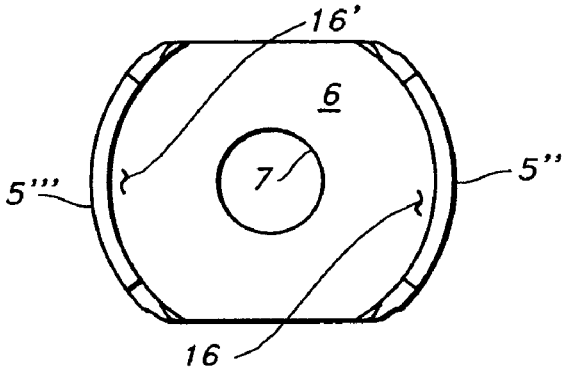
FIG. 22 is top plan view of the holdown connector shown in FIG. 18 with the combination member removed.
Figure 24:
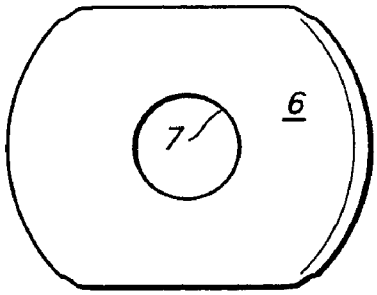
FIG. 24 is a bottom plan view of the holdown connector shown in FIG. 23.

Briefly, the alternate form shown in FIG. 17 is for a holdown connection 1' for holding a circular or circular-like building structural member 2' having a bottom end surface 13'. Circular-like building structural member 2' as shown in FIGS. 17 and 19 may be a solid circular-like sawn timber, a composite solid circular-like composite timber, a circular-like plastic member or solid metal member.

Referring specifically to FIG. 17, a concentric holdown connection 1' joining a held circular-like columnar building structural member 2' to a holding building structural member 3 is shown.

This form of the invention is useful where the architectural requirements require a round wooden post to be connected to a floor or foundation. The alternate connection is also used where the circular-like columnar building structural member 2' is a composite wood, metal, plastic, or even concrete pipe. The circular-like structural members 2' may be solid or tubular.

Homes having full basements with concrete floors frequently use steel column for supporting the ends and mid portions of floor beams. The connector of the present invention serves to securely attach the lower ends of the steel pipes to the concrete floor and foundation. Similar pipe posts are found in commercial buildings of many types.

In its basic form, the concentric holdown connection 1' in FIG. 17 includes: a holdown connector 4' having a first upright portion 5" and a second upright portion 5'" laterally spaced therefrom which are integrally joined to opposite edges of a seat portion 6 having an opening 7 therethrough and are operably connected to held circular-like columnar building structural member 2'.

Also included in the concentric holdown connection 1' are first and second upright portions 5" and 5'" formed in an arc for face to face registration with circular-like columnar building structural member $2_1$; elongated anchor member 8 operably joined to holding building structural member 3 and having a threaded end portion 9 dimensioned for insertion through opening 7 in seat portion 6; and a circular-like combination member 10 formed with a threaded opening 11 for threadably receiving threaded end portion 9 of elongated anchor member 8 and having a base 12 dimensioned and formed for engaging a substantial portion of seat portion 6.

Figure 16:
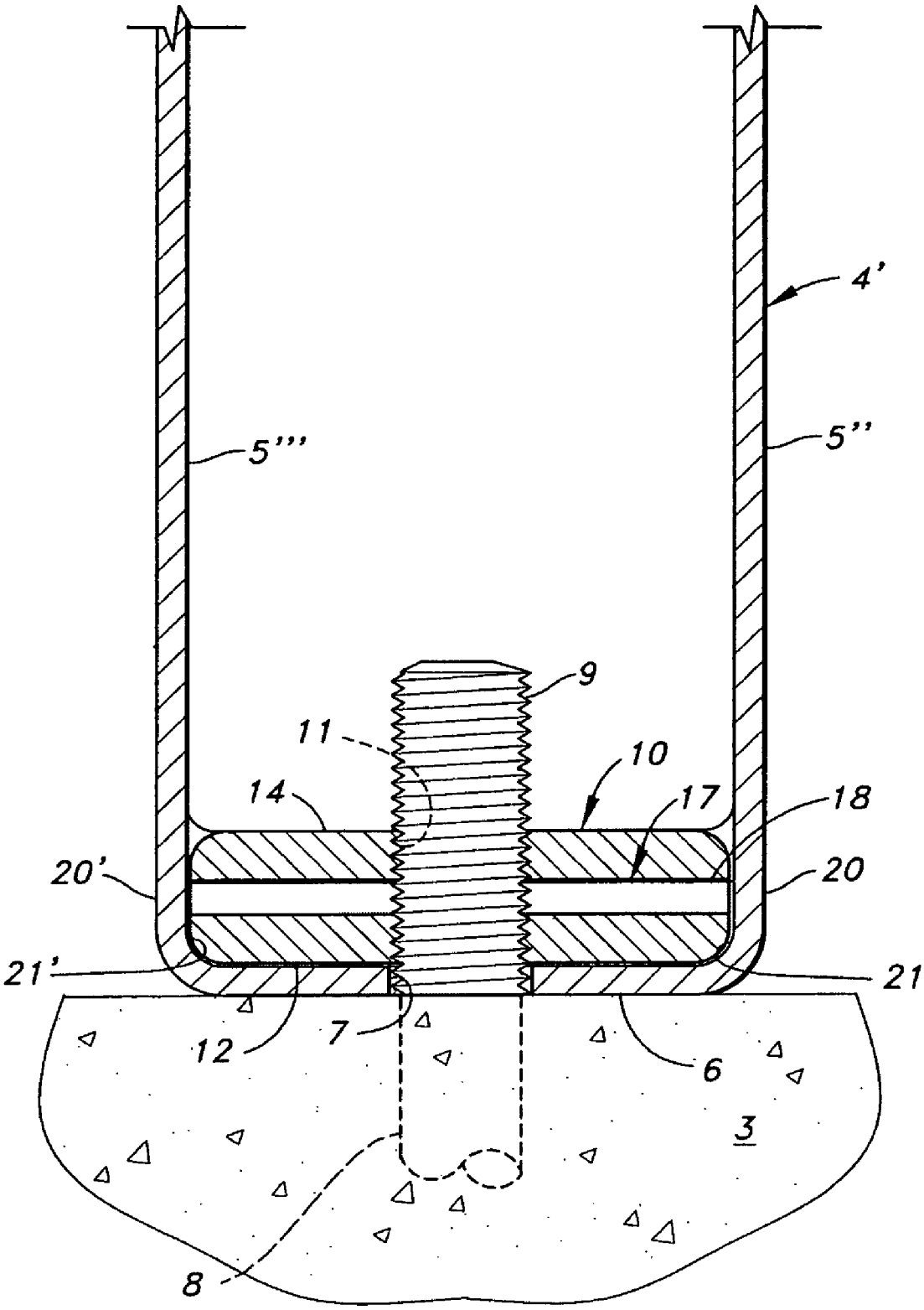
FIG. 16 is a cross sectional front elevation view taken along line 16-16 in FIG. 1. The held member has been removed.
Figure 23:
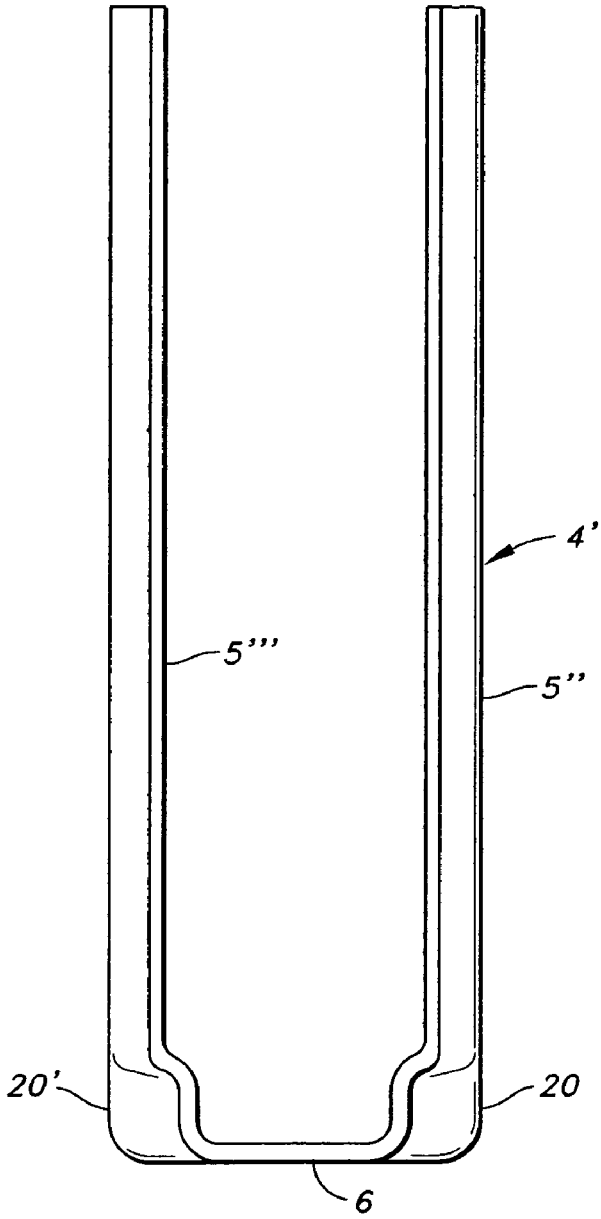
FIG. 23 is a front elevation view of the holdown connector shown in FIG. 18 with the combination member removed.

This form of the invention shown in FIG. 17 also includes cold formed work hardened portions 20 and 20' in first and second upright portions 5 and 5' as shown in FIGS. 16 and 23. Work hardened portions 20 and 20' are deformed inwardly so as to form engagement surfaces 21 and 21' as shown in FIG. 16 for engaging a substantial portion of the circumferential perimeter side edge wall 22 of the combination member 10.

It is to be understood that the term "Circular-like columnar building structural member" includes building structural members which are in fact circular as well as other geometric shapes such as elliptical or column members having partial curved surfaces and which can be held in close registration by the upright portions 5" and 5'". Columns with polygonal with multiple short segment planar sides would be included in "Circular-like" structural members.

The term "circular-like combination member 10", includes combination nut and washer members which are in fact circular as well as other geometric shapes such as elliptical or combination members having partial curved surfaces and which can cover a substantial portion of the seat portion 6 and be held in close registration by the formed portions 20 and 20' of the first and second upright portions 5" and 5'".

Referring generally to the form of the invention disclosed in FIGS. 15-25 B, in a preferred form of concentric holdown connection 1', combination member 10 has a donut-like configuration as previously described. In general, the donut-like combination member 10 has a thicker depth and the lower edges have a greater radius than other forms of the combination member 10 described.

The advantages of the donut-like combination member 10 is a greater resistance to seat bending and less deflection due to elongation of connector members specifically at the intersection of the seat portion member 6 and the upright arcuate members 5" and 5'".

Other advantages which flow from the donut-like configuration of the combination member 10 interacting with the cold formed work hardened portions 20 and 20' are the functions of substantially centering threaded opening 11 in combination member 10 with opening 7 in seat portion 6 of holdown connector 4', and the more important function of transferring load forces 27 (see FIG. 18) along a curved path from first and second upright arcuate portions 5" and 5'" to seat portion 6 which is located at a substantially right angled plane to arcuate upright portions 5" and 5'" with minimal elongation of holdown connector 4' under design loads.

Further, combination member 10 in the donut-like configuration provides substantial reinforcement to upright portions 5" and 5'" adjacent seat portion thereby contributing to the reduction in buckling failure of the first and second arcuate upright portions 5" and 5'" when holdown connector 4' is in compression from the huge downward load forces during cataclysmic events such as earthquakes.

In the most preferred concentric holdown connection 1' as previously described and best illustrated in FIGS. 12 and 16, FIGS. 24A, 24B, 25A, and 25B; formed portions 20 and 20' of first and second arcuate upright portions 5" and 5'" adjacent seat portion 6 are formed in a compound curve to be in close registration with a substantial portion of the lower portion of peripheral side edge 32 of combination member 10 which is also formed in a compound curve by radii normal to and parallel with the axis 28 of said combination member 10.

Figure 25B:
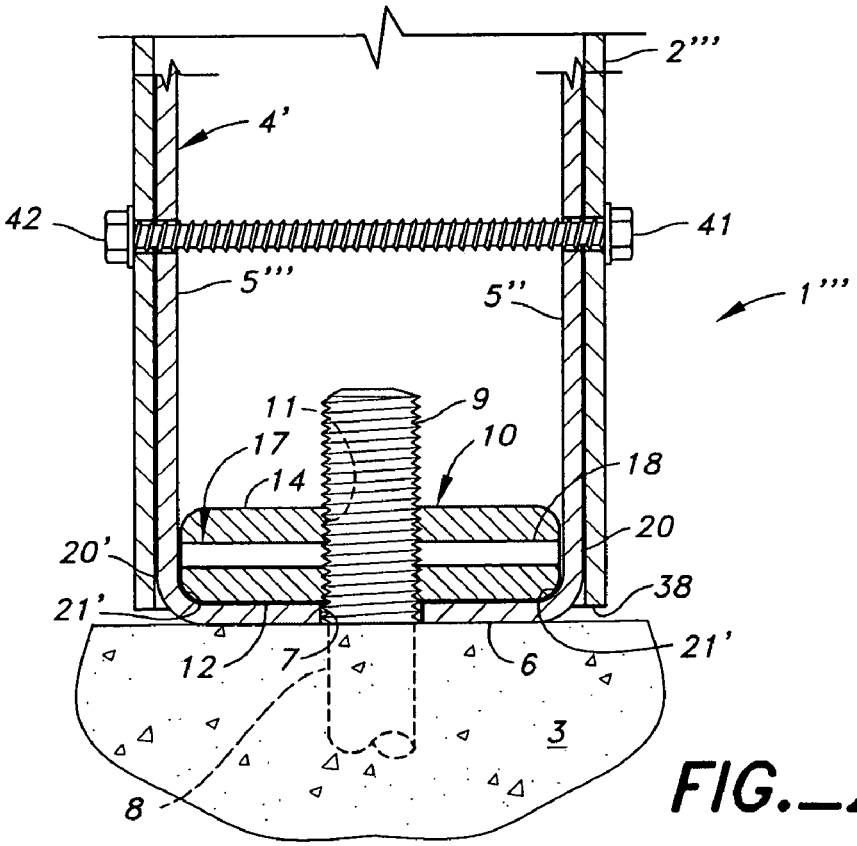
FIG. 25B is a cross sectional elevation view of a portion of the form of the concentric holdown connection illustrated in FIG. 25A and taken along the line 25B-25B.
Figure 25A:
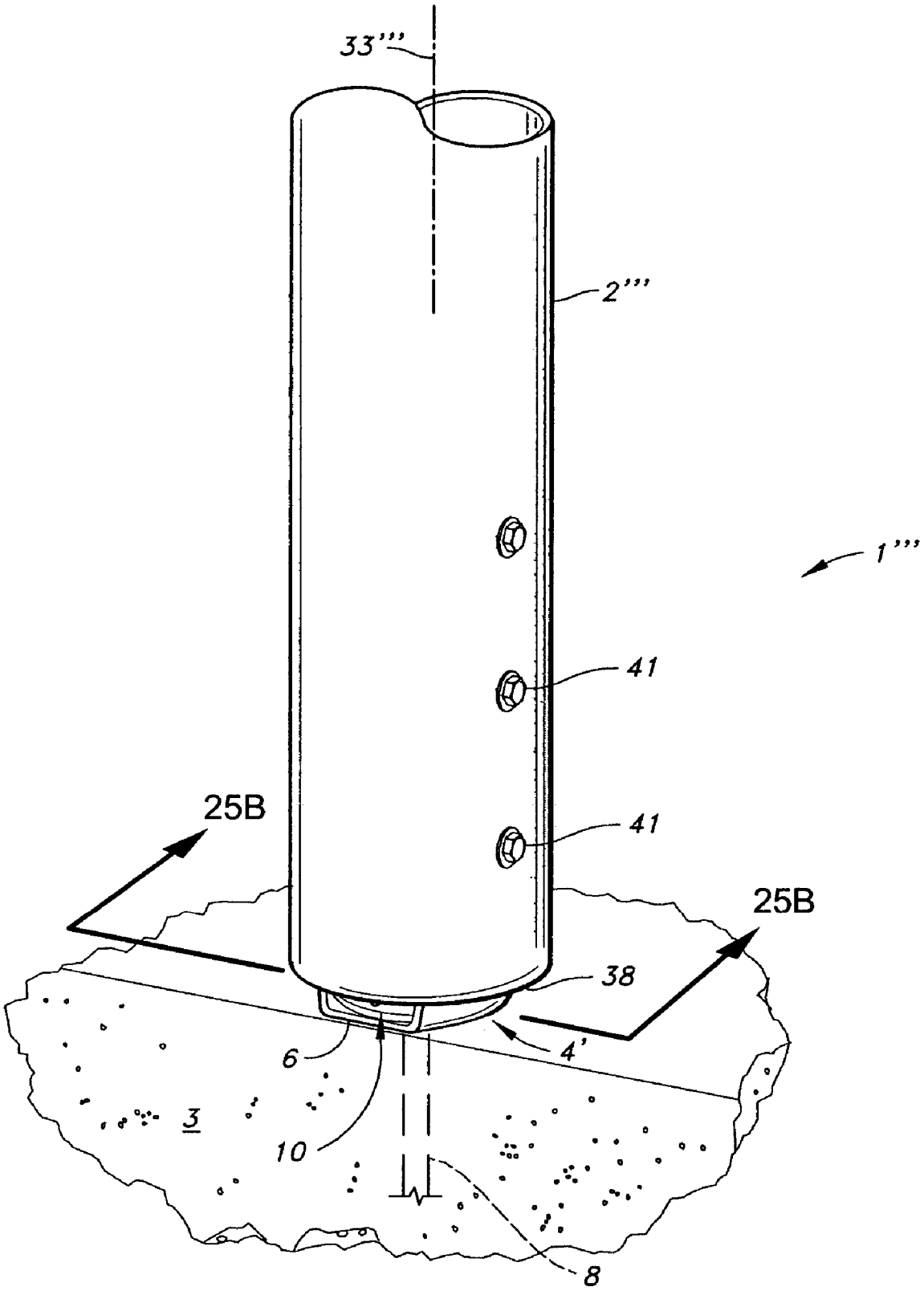
FIG. 25 A is a perspective elevation view of still another form of the invention. The form of the invention illustrated in FIG. 25A is nearly identical to the form of the invention illustrated in FIG. 24A except that the held member in FIG. 25A, in contrast with the form of the invention illustrated in FIG. 24B, has an enlarged cross sectional dimension so that the held member envelopes the holdown connector. In effect, the held member hides the holdown connector.

Another form of the invention is illustrated in FIGS. 25A and 25B which is preferred where it is desirable to hide the holdown connector from view. In Europe e.g., it is generally considered better architectural practice to hide connectors from view. In some upscale housing installations in the United States, e.g., hiding connectors from view is also practiced. In other instances it may be desirable to use a larger size column pipe while being able to use the same size connector as used for installations in which the connector is exposed to view.

In the foregoing installations, the concentric holdown connection 1'" includes: a circular-like columnar building structural member 2'" which may be a steel pipe or other tubular member having a bottom end 38 dimensioned to encircle seat portion 6 and first and second arcuate upright portions 5" and 5'". First and second arcuate upright portions 5" and 5'" are positioned for attachment to circular-like building structural member 2'" such as steel pipe with steel bolts 41 inserted through openings drilled through the upright portions 5" and 5'" and pipe member 2'". A nut 42 is preferably threadably attached to bolts 41 to prevent inadvertent withdrawal.

Figure 24A:
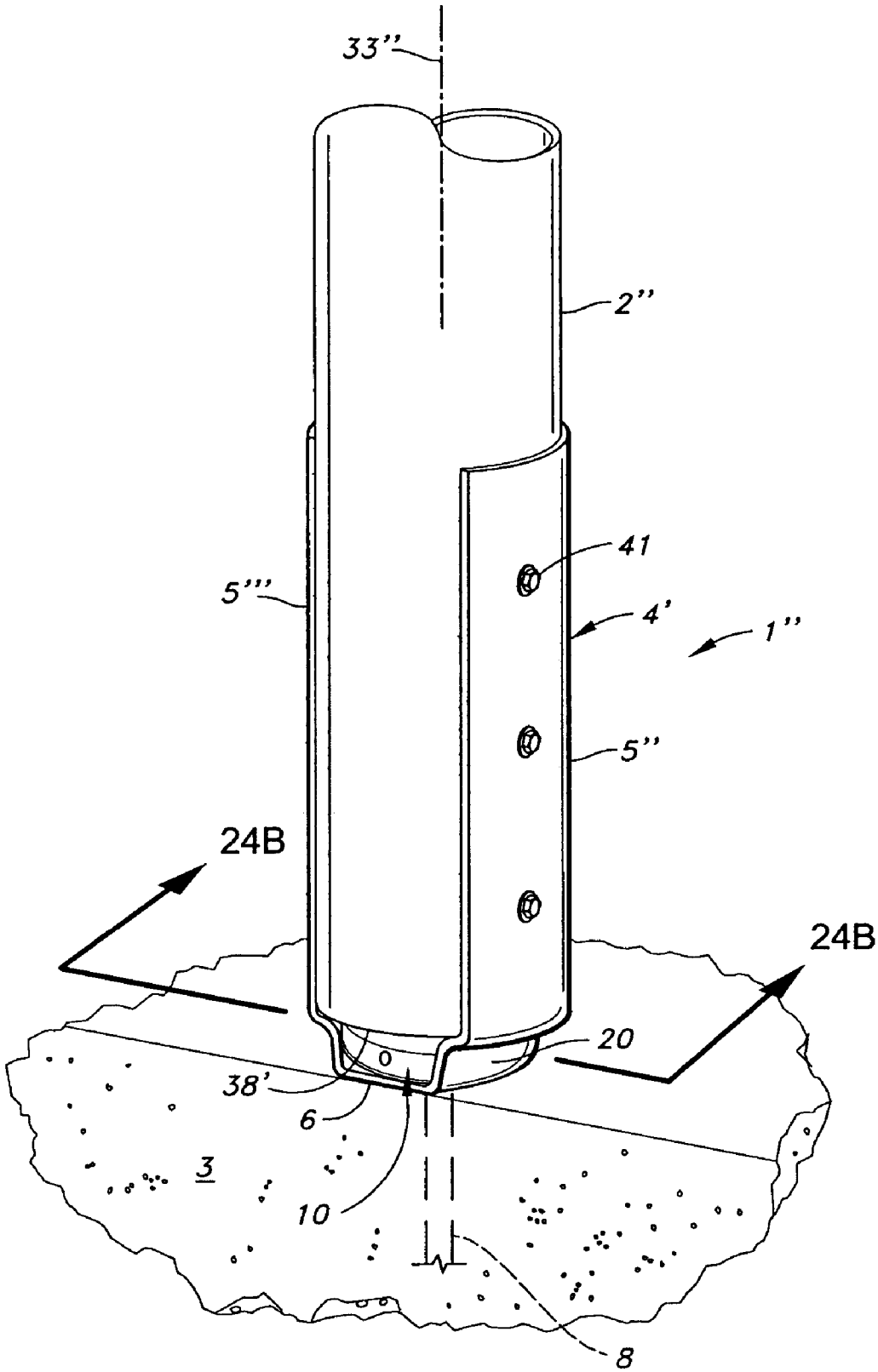
FIG. 24A is an elevation view of still another form of the concentric holdown connection of the present invention shown in perspective.
Figure 24B:
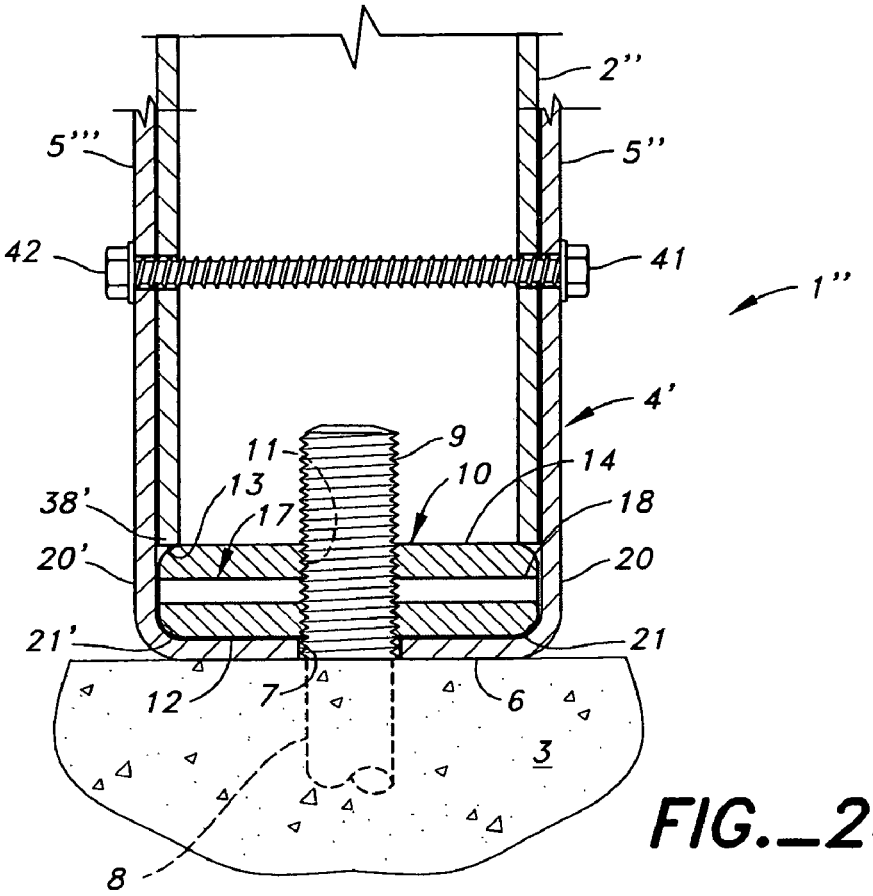
FIG. 24B is a cross sectional elevation view of a portion of the concentric holdown connection illustrated in FIG. 24A and taken along line 24B-24B.

Referring to FIGS. 24A and 24B, another form of concentric holdown connection 1" is illustrated which is identical to the form of the invention illustrated in FIGS. 25A and 25B except as follows. Circular-like columnar building structural member 2" is a steel pipe having a bottom end 38', and is dimensioned to be encircled by first and second arcuate upright portions 5" and 5'" and positioned for resting on combination member 10.

INSTALLATION AND OPERATION

Referring to FIGS. 1-14 of the drawings, the installation and operation of the above described invention is herein described.

Anchor member 8 is preferably located and held by well known suitable means and the concrete is poured. The anchor member 8 may also be installed after the concrete is poured and set by equally well known means of drilling and setting the anchor by means of an epoxy adhesive.

The holdown connector 4 is then lowered over the anchor member 8 through opening 7 in the seat 6 until the base 43 rests on the held building structural member 32 which may be a concrete slab, foundation, or wood or steel base.

When alignment has been checked, combination member 10 is rotatably threadably mounted on anchor member 8 until base 12 of combination member 10 rests on seat 6 of holdown connector 4. Combination member 10 is then tightened down by inserting a tool (not shown) into recess 7 and further rotating combination member 10.

In most installations, to ensure that the threaded anchor 8 completely engages combination member 10, an axial bore 15 should be drilled into the end of held building structural member 2 as shown in FIG. 3. Held building structural member 2 in the preferred installation, is then lowered between first and second upright portions 5 and 5' until its bottom end surface 13 rests on top surface 14 of combination member 10.

To ensure that anchor member 8 is completely threaded onto combination member 10 the concentric holdown connection 1 should be checked by sighting through groove 24 in the upper top surface 14 of combination member 10, or translucent plastic plate member 25 illustrated in FIG. 3, if it has been previously installed.

In some installations where design loads permit, the held building structural member 2 can be held by fasteners 31 as shown in FIG. 2 so that the bottom end surface 13 can be suspended above the top surface 14 of combination member 10. If this design condition exists, no axial bore 15 in held building structural member 2 needs to be made.

In the preferred installation, where the bottom end surface 13 rests on the top surface 14 of combination member 10, The completion of the concentric holdown connection 1 consists of inserting fasteners 31 through openings 40 in first and second upright portions 5 and 5' of holdown connector 4. Fasteners 31 may be screws, lag bolts, or nails and inserted in numbers and locations according to code requirements. A preferred fastener is a Simpson Strong-Tie, STRONG DRIVE® SDS screw described in U.S. Pat. No. 6,109,850.

Referring to FIGS. 15-23, an alternate form of the invention is illustrated. As described above, the Concentric holdown connection 1' is identical to the form of the invention illustrated in FIGS. 1-14 except that the first and second upright portions 5 and 5' of holdown connector 4' are formed in an arc to hold a circular-like held building structural member 2'. The combination member 10 is identical to the combination member 10 used in the form of the invention illustrated in FIGS. 1-14. Only a slight modification of the lower end portions 36 and 36' of upright members 5 and 5' is required due to the fact that the upright members 5 and 5' are now arcuate instead of flat.

Where the parts are identical in the form of the invention illustrated in FIGS. 15-24, to the form of the invention illustrated in FIGS. 1-14, like numbers are used. Where parts are related, but slightly modified, the parts are identified by prime marks (').  Since the inventive concept is the same, like parts have not been re-described.

Installation of the parts of the concentric holdown connection 1' in FIGS. 15-24 is the same as the installation of holdown connection 1 in FIGS. 1-14 and the description is not repeated.

A third alternate form of the invention is illustrated in FIGS. 24A and 24B. Since the only difference is that the held building structural member is tubular instead of a solid member, there is no change in the installation as described for the form of the invention illustrated in FIGS. 1-14, and the installation procedure is not repeated.

A fourth alternate form of the invention is illustrated in FIGS. 25A and 25 B. As previously described, held building structural member 2''' either rests on the holding building structural member 3 or is suspended by bolts 41 above the holding building structural member 3. In either event, the holding building structural member 3 does not rest on combination member 10. Thus held building structural member 3 is lowered over holdown connector 4' and fastened to first and second upright portions 5'' and 5''' after combination member 10 has been secured to elongated anchor member 8.

I claim:

1. A concentric holdown connection joining a held building structural member having a bottom end surface to a holding building structural member formed with a top surface wherein a selected portion is formed with a substantially planar surface area comprising:

a. a holdown connector having first and second laterally spaced upright strap members operably connected to said held building structural member by a plurality of fasteners longitudinally extending along said strap members above said bottom end surface in strap supported portions and said upright strap members have lower end portions which are integrally joined to opposite sides of a seat portion having substantially planar and parallel top and bottom surfaces, and having an opening therethrough, wherein, said seat portion is in aligned engagement with said substantially planar surface area of said holding building structural member;

b. an elongated anchor member operably joined to said holding building structural member and having a threaded end portion inserted through said opening in said seat portion; and c. a combination member i. having a circular donut-like configuration of uniform thickness, ii. having a generally planar top surface aligned with and engaging a substantial portion of said bottom end surface of said held structural building member for providing a column bearing surface, iii. formed with a threaded bore for threadably receiving said threaded end portion of said elongated anchor member, and positioned on said seat of said holdown connector in alignment with said opening in said seat for all rotational positions of said combination member, iv. having a substantially planar base surface parallel to said planar top surface dimensioned and formed for alignment with and engaging substantially the entire area of said seat portion of said holdown connector, v. said threads of said threaded bore continuously extend from said top surface to said base surface of said combination member, vi. having a circular circumferential perimeter compound curved side edge wall which includes large radius upper and lower curved edge portions forming a smooth transition with said generally planar surfaces of said base and said top surfaces, vii. having a diameter equal to or less than the lateral separation between said laterally spaced bottom portions of said first and second strap members, and viii. having a selected thickness substantially less than the diameter of the combination member diameter for providing rigidity to minimize deflection of said seat portion of said holdown connector at selected design loads and to minimize elevation of said held building structural member above said holding building structural member and to maximize the cross sectional bearing area of said top surface of said combination member engaging said bottom end surface of said held building structural member;

d. said substantially planar bottom surface of said seat portion of said holdown connector is positioned in aligned engagement with said substantially planar top surface area of said selected portion of said holding building structural member so that threaded engagement of said threaded bore of said combination member with said threaded anchor member is at a point aligned with the top surface of the seat portion of said holdown connector, which is in close proximity to said top surface area of said selected portion of said holding building structural member;

e. the area of said column bearing top surface of said combination member engaging said bottom end surface of said held building structural member is equal to the total area of the top surface area diminished only by the area of the threaded bore opening of the combination member which is substantially equal to the cross section area of the anchor member; and f. the distance from the bottom surface of the held building structural member to the top surface of the seat portion does not exceed the distance that the threaded bore of the combination member threadably engages the threaded portion of the anchor member;

g. substantially the entire width of each of said lower end portions of said first and second strap members are formed in a circular compound curved wall including a circular large radius curve to be in curvilinear aligned engagement with substantial portions of said circular circumferential perimeter compound curved side edge wall of said combination member for all rotational positions of said combination member; and h. said circular combination member and said circular compound curved wall of said lower end portions of said first and second strap members are dimensioned and formed to permit rotation of said combination member for threadable tightening of said combination member on said threaded end portion of said anchor member.

2. A concentric connection holdown as defined in claim 1 comprising:

a. said bottom end surface of said held building structural member is penetrated by an axial bore for receiving said threaded end portion of said elongated anchor member.

3. A concentric holdown connection as defined in claim 1 wherein:

a. said combination member is formed with at least one recess formed and dimensioned for receiving a tool capable of rotating said combination member.

4. A concentric holdown connection as defined in claim 3 comprising;

a. said recess in said combination member is formed in said circumferential perimeter side edge wall and extends radially into said combination member.

5. A concentric holdown connection as defined in claim 1 comprising:

a. said upright strap members of said holdown connector formed with said circular compound curved walls are positioned with respect to said seat portion to form stop limit means for engaging said combination member for aligning said opening in said combination member with said opening in said seat portion.

6. A concentric holdown connection as defined in claim 1, comprising:

a. an inspection groove formed in said top surface of said combination member extending from said circumferential perimeter side edge wall to said threaded opening for determining the selected threaded engagement of said threaded end portion of said elongated anchor member with said combination member.

7. A concentric holdown connection as defined in claim 1 comprising:

a. a plastic plate inspection member placed in contact alignment with said top surface of said combination member and formed with a translucent portion to enable inspection to determine that said threaded end portion of said elongated anchor member is properly installed in said threaded opening of said combination member.

8. A concentric holdown connection as defined in claim 1 for transferring shear load forces between said held building structural member and said elongated anchor member embedded in said holding structural member along a load path comprising:

a. said holdown connector first and second laterally spaced upright strap members directly connected to said held building structural member;

b. said first and second upright strap members adjacent said seat portion which are deformed inwardly so as to form engagement surfaces for engaging a substantial portion of the perimeter of said combination member; and c. said combination member wherein said threaded bore of said combination member directly engages said anchor member at said point wherein said base surface of said combination member is in aligned direct engagement with said top surface of said seat member and said seat member is in aligned direct engagement with said top surface of said holding building structural member.

9. A concentric holdown connection as defined in claim 8 wherein:

a. a substantial portion of said upright portions of said holdown connector adjacent said seat portion which are deformed inwardly, project radially inwardly against a substantial portion of said large upper curved edge portions of said combination member to form a frictional engagement lock with said combination member.

* * * * *

UNITED STATES PATENT AND TRADEMARK OFFICE

CERTIFICATE OF CORRECTION

PATENT NO. : 7,296,386 B2
APPLICATION NO. : 10/920577
DATED : November 20, 2007
INVENTOR(S) : William F. Leek It is certified that error appears in the above-identified patent and that said Letters Patent is hereby corrected as shown below:

Col. 8, line 17
replace "11.4""
with --1 1/4"--

Signed and Sealed this

Eighteenth Day of November, 2008

JON W. DUDAS
*Director of the United States Patent and Trademark Office*